US008358079B2

(12) United States Patent
Samejima et al.

(10) Patent No.: US 8,358,079 B2
(45) Date of Patent: Jan. 22, 2013

(54) DISCHARGE LAMP LIGHT APPARATUS

(75) Inventors: Takanori Samejima, Hyogo (JP); Masashi Okamoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/926,621

(22) Filed: Nov. 30, 2010

(65) Prior Publication Data

US 2011/0127926 A1 Jun. 2, 2011

(30) Foreign Application Priority Data

Dec. 1, 2009 (JP) ..... 2009-273051

(51) Int. Cl.
*H05B 39/02* (2006.01)
*G05F 1/00* (2006.01)

(52) U.S. Cl. ..... 315/209 R; 315/291

(58) Field of Classification Search ..... 315/200 R, 315/209 R, 211, 212, 213, 214, 291, 287, 315/307, DIG. 2, DIG. 4, DIG. 5
See application file for complete search history.

(56) References Cited

U.S. PATENT DOCUMENTS

| | | | | |
|---|---|---|---|---|
| 4,060,751 | A | 11/1977 | Anderson | |
| 5,677,602 | A | 10/1997 | Paul et al. | |
| 5,932,976 | A | 8/1999 | Maheshwari et al. | |
| 6,160,362 | A | 12/2000 | Shone et al. | |
| 6,380,694 | B1 | 4/2002 | Uchihashi et al. | |
| 6,518,712 | B2 | 2/2003 | Weng | |
| 6,546,346 | B1 | 4/2003 | Laubenstein et al. | |
| 6,605,906 | B2 * | 8/2003 | Okamoto et al. | 315/291 |
| 6,700,801 | B2 * | 3/2004 | Morita et al. | 363/21.12 |
| 6,965,204 | B2 | 11/2005 | Langeslag | |
| 7,019,468 | B2 | 3/2006 | Deurloo et al. | |
| 7,110,267 | B2 | 9/2006 | Lurkens | |
| 7,141,937 | B2 | 11/2006 | Kumagai et al. | |
| 7,239,090 | B2 * | 7/2007 | Okamoto et al. | 315/219 |
| 7,332,874 | B2 | 2/2008 | Samejima et al. | |
| 7,382,093 | B2 | 6/2008 | Suzuki et al. | |
| 7,486,028 | B2 | 2/2009 | Langeslag et al. | |
| 7,692,391 | B2 | 4/2010 | Nakada et al. | |
| 2010/0084988 | A1 | 4/2010 | Nagata et al. | |

FOREIGN PATENT DOCUMENTS

| | | | |
|---|---|---|---|
| EP | 0 408 121 | A2 | 1/1991 |
| EP | 0 456 247 | A1 | 11/1991 |
| JP | 55-148393 | A | 11/1980 |
| JP | 02-21509 | A | 8/1990 |
| JP | 03-167795 | A | 7/1991 |
| JP | 04-017296 | A | 1/1992 |

(Continued)

*Primary Examiner* — Minh D A
(74) *Attorney, Agent, or Firm* — Rader, Fishman & Grauer PLLC

(57) ABSTRACT

A discharge lamp lighting apparatus for lighting a discharge lamp where a voltage generated in a secondary side winding can be superimposed on an output voltage of an inverter and is impressed between electrodes, where while a periodic drive circuit generates an inverter drive signal so that frequency of the inverter becomes a start-up initial frequency, electric supply control circuit controls a power supply circuit to output no-load opening voltage, where the frequency of the inverter gradually decreases until reaching a first threshold frequency from the start-up initial frequency, where when the frequency of the inverter reaches the first threshold frequency, the periodic drive circuit generates the inverter drive signal so that the frequency of the inverter becomes stable lighting frequency, and where the electric supply control circuit controls the power supply circuit to output current which is sufficient to maintain electric discharge of the discharge lamp.

11 Claims, 10 Drawing Sheets

FOREIGN PATENT DOCUMENTS

| | | | |
|---|---|---|---|
| JP | 04-121997 | A | 4/1992 |
| JP | 04-342990 | A | 11/1992 |
| JP | 07-169583 | A | 7/1995 |
| JP | 07-230882 | A | 8/1995 |
| JP | 08-124687 | A | 5/1996 |
| JP | 2000-012257 | A | 1/2000 |
| JP | 2000-195692 | A | 7/2000 |
| JP | 2001-338789 | A | 12/2001 |
| JP | 2004-095334 | A | 3/2004 |
| JP | 2004-127656 | A | 4/2004 |
| JP | 2004-221031 | A | 8/2004 |
| JP | 2004-265707 | A | 9/2004 |
| JP | 2004-327117 | A | 11/2004 |
| JP | 2005-038814 | A | 2/2005 |
| JP | 2005-050661 | A | 2/2005 |
| JP | 2007-005260 | A | 1/2007 |
| JP | 2007-103290 | A | 4/2007 |
| JP | 2007-173121 | A | 7/2007 |
| JP | 2007-179869 | A | 7/2007 |
| JP | 2008-027705 | A | 2/2008 |
| JP | 2008-171742 | A | 7/2008 |
| JP | 2008-269836 | A | 11/2008 |
| JP | 04-272695 | A | 6/2009 |

* cited by examiner

DISCHARGE LAMP LIGHT APPARATUS

CROSS-REFERENCES TO RELATED APPLICATION

This application claims priority from Japanese Patent Application Serial No. 2009-273051 filed Dec. 1, 2009, the contents of which are incorporated herein by reference in their entirety.

TECHNICAL FIELD

The present invention relates to a discharge lamp lighting apparatus for lighting a high pressure discharge lamp, specifically a high intensity discharge lamp, such as a high pressure mercury discharge lamp, a metal halide lamp, and a xenon lamp.

BACKGROUND

For example, a high intensity discharge lamp (hereinafter referred to as a HID lamp) is used for a light source apparatus for an optical apparatus for displaying an image, such as an LCD projector and a DLP (Trademark) projector. In such a projector, light is separated into the three primary colors of red, green, and blue by a dichroic prism etc., so that a space modulation element provided for each color generates an image of each of the three primary colors. The optical paths are combined by a dichroic prism(s) etc., to display a color image. In another known type of projector, light emitted from alight source is passed through a rotating filter having three primary color areas (R, G, and B), thereby sequentially generating light rays of the three primary colors. In synchronization with the generated light rays, the spatial modulation elements are controlled to sequentially generate an image of each of the three primary colors in a time dividing manner, thereby displaying a color image.

There are two types of driving methods in a steady lighting period of a discharge lamp, that is, a direct-current driving method and an alternating current driving method, in which periodic polarity reversals are performed by further providing an inverter. In the case of the direct current driving method, since the light flux from a lamp is like direct current, that is, it does not change with passage of time, there is a great advantage that it can be basically similarly applied to both types of the above-described projectors. On the other hand, in the case of the alternating current driving method, while development or wear of the electrode(s) of the discharge lamp can be controlled by using the flexibility of polarity-reversal frequency that does not exist in the direct-current driving method.

When this type of a lamp is initiated, while voltage called no-load open circuit voltage is impressed to the lamp, high voltage is impressed to the lamp, to generate dielectric breakdown in an electrical discharge space, so that the discharge state changes from glow discharge to arc discharge. As a conventional method of carrying out the start-up incase of an alternating current driving method, there has been a resonance starting that is accomplished by a series resonance system, in which a series resonant circuit made up of a resonance inductor and a resonant capacitor is provided in an output side of an inverter, wherein at time of start-up, polarity frequency of the inverter is set up to agree with the resonance frequency of the resonant circuit, thereby generating a series resonance phenomenon, so that voltage to be impressed to the lamp is increased. Furthermore, by using the resonance starting in combination with an igniter, a peak value of high voltage to be impressed thereto is increased thereby increasing starting probability.

FIG. 15 is a schematic view of the structure of an example of a conventional discharge lamp lighting apparatus. The principle of resonance starting will be described below, referring to FIG. 18. The discharge lamp lighting apparatus shown in the figure comprises a power supply circuit (Ux') that supplies electric power to a discharge lamp (Ld), an a full bridge type inverter (Ui') for inverting the polarity of an output voltage, and a resonance inductor (Lh') and a resonant capacitor (Ch'), wherein at start-up time, the inverter (Ui') is driven in an polarity-reversal driving operation at resonance frequency determined by a value of the product of the inductance of the resonance inductor (Lh') and the electrostatic capacity of the resonant capacitor (Ch'), or at frequency close to the resonance frequency, so that high voltage is generated between both terminals of the resonant capacitor (Ch') due to an LC series resonance phenomenon that is developed by the driving, whereby the high voltage is impressed to the discharge lamp (Ld).

In addition, the circuit configuration of a power system of the power supply circuit (Ux') and the inverter (Ui'), is the same as that of the power supply circuit (Ux) and the inverter (Ui') as will hereinafter be described. Moreover, in the case of generation of resonance phenomena, it may also include a case where harmonic (oddth order) of the frequency of a polarity-reversal driving operation is made to correspond to LC resonance frequency.

Although, that resonance current that flows through the inverter (Ui') does not become excessive, it is necessary to make the electrostatic capacity of the resonant capacitor small, and to increase the inductance of the resonance inductor to some extent at time of the series resonance operation, if the inductance is large, it tends to cause instantaneous interruption of lamp flux, overshoot, and vibration at time of steady lighting.

And, in such a series resonance system, to sufficiently raise voltage impressed to a lamp, frequency of a periodic voltage applying unit or frequency of a higher harmonic component needs to be set up to agree (namely, be syntonized) with the resonance frequency or oddth frequency of the resonance frequency of the resonant circuit.

However, since there is manufacturing tolerance in parts, even if the inverter (Ui') is driven in a polarity-reversal driving operation at predetermined and fixed frequency determined by the design inductance of the resonance inductor (Lh') and the design electrostatic capacity of the resonant capacitor (Ch'), there is a problem in which expected high voltage cannot be obtained. Furthermore, in such a case where there is the manufacturing tolerance, although the resonance frequency of each discharge lamp lighting apparatus may be measured to set up it, since there are also affects of the length of cables for connection and a degree of a proximity of the cables to other electrical conductor, etc., there is a problem in which it is difficult to rigorously set up the resonance frequency in advance.

To solve this problem, a method of setting up the driving frequency of the inverter (Ui') to the above-mentioned resonance frequency or frequency close to the driving frequency or a method of performing a sweep operation, is proposed in the prior art. FIG. 16 is a simplified timing chart of an example of a conventional discharge lamp lighting apparatus. In the figure, (a) shows a waveform of output voltage (Vnh) that is generated in the resonant capacitor (Ch'), and (b) shows change of the driving frequency (f) of the inverter (Ui). This figure shows that an automatic sweep operation of frequency of alternating current voltage, which the inverter (Ui') generates at time of start-up of lamp lighting, is repeatedly performed in a predetermined range including the resonance frequency of the resonant circuit, wherein, in a period (Ta), the sweep operation is performed from a lower limit frequency towards a upper limit frequency, and in a process of the operation, the output voltage (Vnh) turns into high voltage at a time point (ta) at which the frequency of the alternating current voltage generated by the inverter circuit is in agreement with the resonance frequency by chance. On the other hand, in a period (Tb), the sweep operation is performed in an opposite direction thereto from the upper limit frequency towards the lower limit frequency. Therefore, the sweep operation is repeated twice or more, in a range of resonance frequencies expected from the manufacturing tolerance, within a predetermined period (T) of start-up time of the lamp lighting, and the high voltage is impressed to the discharge lamp (Ld). The peak voltage of this high voltage is set up, to for example, 2 kV-5 kV (since the peak voltage is obtained by measuring voltage reaching the peak value from 0 V, the way of measuring the peak of high voltage of alternating current is the same throughout the present specification).

However, in a period, in which the driving frequency of the inverter (Ui') is largely different from the resonance frequency or frequency close to the resonance frequency (in the figure, all periods in which output voltage (Vnh) is relatively low, which are typified by a period (Tc)), and which is within the period (T) where high voltage is impressed to a discharge lamp to start an operation, there is a problem in which a rise in voltage due to resonance does not occur at all as to the output voltage (Vnh).

Various proposals in technology, such as one described above, have been made conventionally, in which a sweep operation of the driving frequency is repeated and continues over an entire discharge lamp start-up period, without specifying timing at which the driving frequency of an alternating current driving circuit is in agreement with the resonance frequency.

Japanese Patent Application Publication No. H02-215091 discloses that conditions, under which the driving frequency is in agreement with resonance frequency, is satisfied at least for a moment, and an automatic sweep operation of the frequency of the alternating current voltage that an inverter circuit generates at start-up time of lighting is performed in a predetermined range including the resonance frequency of a resonant circuit.

Moreover, Japanese Patent Application Publication No. H03-102798 discloses that a high frequency unit, which makes an LC circuit impress high voltage to a lamp, is provided so that the lamp may be lighted, wherein the high frequency unit applies, to the LC circuit, frequency that changes with passage of time or frequency that decreases from frequency higher than the resonance frequency with passage of time.

Moreover, Japanese Patent Application Publication No. H04-017296 discloses that when oscillation frequency of an inverter unit is changed into high frequency, it is configured so that the oscillation frequency may be changed within a predetermined range according to output voltage of a saw-tooth wave generating unit or a triangular wave generating unit.

Furthermore, Japanese Patent Application Publication No. H04-272695 discloses that an inverter is controlled so that output frequency of the inverter is continuously changed to frequency lower than a frequency range in which an acoustic resonance phenomenon may occur due to the resonance frequency of an LC circuit at start-up, or an inverter is controlled so that frequency may become lower than a frequency range in which an acoustic resonance phenomenon may occur at stationary time.

Furthermore, Japanese Patent Application Publication No. H10-284265 discloses that frequency of alternating current voltage outputted from an output connection section in a start-up period is swept (changed) within a range including the resonance frequency of a resonant circuit, or alternating current voltage of high frequency is outputted from the output connection section in a start-up period and only the alternating current operating voltage of low frequency is supplied to a discharge lamp in a steady lighting period after the start-up of the discharge lamp.

Furthermore, Japanese Patent Application Publication No. 2000-195692 discloses that, as an embodiment, operating frequency of a bridge in a resonance operation is swept (varied) to pass a resonance point.

Furthermore, Japanese Patent Application Publication No. 2001-338789 discloses that the switching frequency of each switching element is controlled to be continuously changed for predetermined time, wherein the sweep range of the switching frequency includes resonance frequency determined by an inductor and a capacitor of a load resonance circuit, or frequency is controlled to be changed, that is, swept, from higher frequency to lower frequency during a predetermined period, or when the resonance frequency changes after insulation breakdown of a discharge lamp, frequency of an inverter is also changed, so that large energy is supplied to arc discharge, whereby a discharge state of the discharge lamp more stably shifts to arc discharge.

Furthermore, Japanese Patent Application Publication No. 2002-151286 discloses that, as an embodiment, a sweep operation of the driving frequency of an inverter is repeated twice or more times, and the frequency is changed and shifted from high frequency to low frequency in arc lighting.

Furthermore, Japanese Patent Application Publication No. 2004-146300 discloses that as an embodiment, although two resonance systems are used, a sweep operation is performed using a microprocessor, wherein the lower limit frequency and the upper limit frequency of a frequency sweep range are set to define a frequency variable range that can be covered even if the resonance frequency changes due to manufacturing tolerance of parts of a resonant circuit section or floating capacitance of an output line from a high pressure discharge lamp lighting apparatus to the lamp.

Furthermore, Japanese Patent Application Publication No. 2004-221031 discloses a discharge lamp lighting apparatus having a control unit for at least setting up frequency in a first step to be frequency close to that obtained by dividing resonance frequency of a resonant circuit by an odd number while gradually decreasing frequency of the rectangular wave, wherein the frequency and the duty ratio of a DC-DC converter circuit, which is arranged in an upstream side of an inverter, are changed to suppress resonance voltage due to manufacturing tolerance of LC parts.

Furthermore, Japanese Patent Application Publication No. 2005-038813 discloses that, as an embodiment, frequency of an inverter in a high frequency switching operation at start-up time is changed continuously or in a stepwise fashion, to perform oddth resonance.

Furthermore, Japanese Patent Application Publication No. 2005-050661 discloses that, as an embodiment, output frequency of an inverter is continuously changed from an upper limit to a lower limit in a discharge lamp start-up time, and if it reaches the lower limit, the same operation is repeated after returning to the upper limit, to pass a resonance point.

Furthermore, Japanese Patent Application Publication No. 2005-038814 discloses that, as an embodiment, although a half bridge function and a step down chopper function are attained by two switching elements, frequency of an inverter is swept by dividing it twice or more times, to perform an operate at start-up at frequency that is one divided by an odd number of the resonance frequency.

Furthermore, Japanese Patent Application Publication No. 2008-243629 discloses that, to obtain resonance frequency, a sweep operation of frequency of an inverter is repeatedly carried out, or frequency of an inverter in an unloaded condition, starting improving mode, and each mode in a steady lighting state, is set as follows: non-load condition>steady lighting state>starting improving mode.

Thus, the proposal of the prior art is described above, that is, a sweep operation of the driving frequency is repeated and continues over an entire discharge lamp start-up period, without specifying timing at which the driving frequency of an alternating current driving circuit, such as an inverter is in agreement with the resonance frequency. However, as described above, in an operation period, in which the inverter (Ui') is operated at frequency largely different from the resonance frequency or from frequency close to the resonance frequency, and which is within the period (T) where high voltage is impressed to a discharge lamp to start an operation, the problem in which a rise in voltage due to resonance does not occur at all has not been solved.

To solve this problem, in the prior art, it has been proposed that driving frequency of the inverter (Ui') is automatically syntonized with or set to the resonance frequency of the resonant circuit that is made up of the resonance inductor (Lh') and the resonant capacitor (Ch'), or frequency close thereto or higher order resonance frequency.

Description of a discharge lamp lighting apparatus shown in FIG. 15 will be given below. The circuit includes an a full bridge type inverter (Ui') for inverting the polarity of an output voltage, and a resonance inductor (Lh') and a resonant capacitor (Ch'), wherein an polarity-reversal driving operation is performed at resonance frequency or frequency close to the resonance frequency, so that high voltage is generated between both terminals of the resonant capacitor (Ch') due to an LC series resonance phenomenon that is developed by the driving, whereby the high voltage is impressed to the discharge lamp (Ld). However, a syntonization degree detection unit (Un'), which serves as a detection unit for detecting whether resonant condition is realized, is provided to control the output voltage (Vnh).

FIG. 17 is a schematic timing chart of an example of a conventional discharge lamp lighting apparatus, in the case where the syntonization degree detection unit (Un') for controlling the inverter (Ui') relating to series resonance, is used. In the figure, (a) shows a waveform of output voltage (Vnh) generated in the resonant capacitor (Ch'), and (b) shows change of the driving frequency (f) of the inverter (Ui'). The figure shows frequency of alternating current voltage that the inverter (Ui') generates at time of lighting start-up is automatically changed in a range including resonance frequency of a resonant circuit, wherein in a period (Td), a sweep operation is performed from a lower limit frequency towards an upper limit frequency, and at time (td), resonance is realized and the syntonization degree detection unit (Un') formed from a voltage detection unit detects that output voltage (Vnh) reached a target voltage, so that the frequency (fp) is maintained thereby generating intended high voltage continuously.

Since the output voltage (Vnh) is set up so that peak voltage may be set to 2 kV-5 kV as described above, the syntonization degree detection unit (Un') needs to have the capability of withstanding the high voltage. As an example of the detection unit for realizing the resonant condition, it is necessary to measure voltage, between a connection node of a resonant capacitor (Ch') and a resonance inductor (Lh'), and a ground, or between both ends of a discharge lamp (Ld), thereby generating a signal. For example, resistor elements and capacitors are in series aligned, to withstand the high voltage, so that a signal can be acquired from a middle point at which voltage is divided. However, in such an example, since the number of component parts increases, there is a problem in which it becomes disadvantageous in view of a miniaturization and cost reduction of such a discharge lamp lighting apparatus.

Moreover, as another example of the detection unit for realizing the resonant condition, a secondary winding that has a small turn ratio suitable for a resonance inductor (Lh') is added thereto, and a resonance inductor (Lh') is configured to have a transformer structure, wherein a signal having amplitude voltage that is obtained from the secondary winding and that is approximately proportional to amplitude voltage of the resonance inductor (Lh'), is rectified by using a resistor, a diode, a capacitor, etc., thereby forming the voltage detection unit. However, in this example, since the above described high voltage is generated at the resonance inductor at start-up time, in the resonance inductor (Lh'), which has the transformer structure, it is necessary to sufficiently secure insulation of a secondary winding to the high voltage generating section, and to prevent breakdown or corona discharge. Therefore, there is a problem in which a method of sufficiently providing a barrier tape or a tape between winding layers, or a method of separating each winding, section by section, is adopted, thereby causing an increase in cost.

As another example of the detection unit for detecting that the resonant condition is realized, by using a phenomenon in which large current flows from the inverter (Ui') when the driving frequency of an inverter (Ui') is in agreement with the resonance frequency of a resonant circuit, it is considered that a current detection unit for the inverter (Ui') is provided. However, when a resistor having small resistance is used as the current detection unit, there is a problem in which unnecessary resistive loss may be caused since current also flows therethrough steadily in a steady operation during which a discharge lamp is lighted, or cost increases in case of a system in which a current transformer is arranged at an output of the inverter (Ui').

As still another example of the detection unit for detecting that the resonant condition is realized, a system is proposed, in which a current phase detection unit for an inverter, and a voltage phase detection unit for the inverter are provided so that a detected inverter current phase and an inverter voltage phase are compared with each other, whereby a feedback operation is performed to actually realize a predetermined phase relation. However, similarly to the above, in this system, a circuit for the comparison/judgment of a phase, and a current transformer for current detection or a resistor for current detection are required, so that there is a drawback of an increase in cost.

As stated above, various technologies having a detection unit for detecting whether a resonant condition is realized, in which the driving frequency of an inverter is set up to be in agreement with resonance frequency to continuously generate high voltage, have been conventionally proposed.

For example, Japanese Patent Application Publication No. S52-121975 discloses that where operation frequency is changed and then the operation frequency is fixed when a resonance condition is detected, an inverter is driven at the triple harmonic of resonance frequency, and the inverter looks for the resonance frequency so that an operation is performed at the frequency.

For example, Japanese Patent Application Publication No. S55-148393 discloses that in the case where a resonant condition is maintained like self-oscillation, a unit for detecting current that flows through a resonant circuit at time of start-up of a discharge lamp containing gas, is prepared, wherein when a change rate is the maximum or close to the maximum, frequency of an inverter is maintained at the resonance frequency of the resonant circuit by commutating the voltage that is impressed to the resonant circuit.

Moreover, Japanese Patent Application Publication No. 2000-012257, similarly to the above, in the case where a resonant condition is maintained like self-oscillation, where a discharge lamp is started in a resonant condition, syntonization is automatically performed by self-oscillation of a resonant circuit that is made up of an inductor and a capacitor.

Furthermore, Japanese Patent Application Publication No. 2001-501767 discloses that a detection unit is configured so that a state of a gas discharge lamp is detected, and a control circuit unit controls frequency of an inverter as a function of an output of the detection unit. The Japanese Patent Application Publication also discloses that a feedback circuit unit for effectively changing frequency of an inverter in response to an electric power detection unit is provided, wherein electric power supplied to a gas discharge lamp is maintained to approximately a predetermined level. Further, the Japanese Patent Application Publication discloses that the inverter is configured to be continuously operated at frequency that decreases so that the frequency approaches resonance frequency until a gas discharge lamp starts and thereafter; the inverter is configured to be operated at frequency which decreases to approach frequency close to specific frequency until at least the operation of the gas discharge lamp shifts from glow discharge mode to arc discharge mode; and the inverter is operated at frequency higher than other resonance frequency after the operation of the gas discharge lamp shifts from glow discharge mode to arc discharge mode, so that the gas discharge lamp starts, and shifts from the glow discharge mode to the arc discharge mode, and further is operated in a steady state. Or, the Japanese Patent Application Publication discloses that a step in which the inverter is operated at frequency that decreases so that it may approach from specific frequency to resonance frequency until the gas discharge lamp starts; a step in which the inverter is operated at frequency that increases to approach the specific frequency until the gas discharge lamp shifts from glow discharge to arc discharge; and a step in which the inverter is operated at frequency higher than other resonance frequency at which the gas discharge lamp is stably operated.

Furthermore, Japanese Patent Application Publication No. 2001-511297 discloses that a system about a detection and determination method of resonance frequency at the driving frequency of a bridge is proposed, wherein a search method is performed based on random sampling and, for example, is continuously carried out until breakdown of the gas electric light lamp and an ignition of the gas discharge lamp occur.

Furthermore, Japanese Patent Application Publication No. 2001-515650 discloses that bridge frequency is decreased in each phase of non-load, glow discharge and arc discharge, wherein first, a resonance igniter is controlled to be excited at frequency sufficiently higher than nominal resonance frequency, and excitation frequency is decreased while supervising lamp terminal voltage, or where frequency is decreased toward the nominal resonance frequency and the terminal voltage of the lamp increases, when and the measured lamp terminal voltage reaches a minimum value at the controlled frequency, a controller stops decreasing the frequency and the lamp is continuously excited over designated minimum duration at this frequency.

Furthermore, Japanese Patent Application Publication No. 2004-095334 discloses that a frequency detection unit for detecting frequency of driving voltage of an inverter and a voltage detection unit for detecting voltage that is generated by driving a resonant circuit, are provided in a resonant circuit unit, wherein the driving frequency is changed from high frequency to low frequency whereby frequency at the time when the voltage detection unit detects the maximum voltage, is set as the driving frequency. The Japanese Patent Application Publication also discloses that the driving frequency is changed from high frequency to low frequency whereby frequency at the time when the voltage detection unit detects a threshold voltage, is set as the driving frequency. Further, the Japanese Patent Application Publication also discloses that in the above-mentioned frequency detection, constant voltage smaller than starting voltage, which may start a discharge lamp, is impressed to a resonant circuit, or the secondary winding of a resonance inductor is used as a voltage detection unit, or a measurement is performed at a connection node of a resonant capacitor and a resonance inductor.

Moreover, Japanese Patent Application Publication No. 2004-127656 discloses that after frequency of output voltage of an inverter circuit is set to frequency lower than the oddth resonance frequency of a resonant circuit to turn on a discharge lamp, the frequency of output voltage is increased gradually or stepwise, and the frequency of the output voltage, at time when the amplitude of oscillating voltage of the resonant circuit becomes a predetermined value or greater, is set as the frequency of the output voltage of the inverter circuit. Also, the Japanese Patent Application Publication discloses that when the amplitude of the output voltage of the resonant circuit does not reach a predetermined value or greater within a predetermined time, after the frequency of the output voltage reaches an upper limit, if the amplitude of the output voltage of the resonant circuit becomes the predetermined value or greater in a process in which the frequency is decreased to targeting initial frequency, which is frequency at time of start-up, at a speed equivalent to the speed at time when the frequency is increased, frequency that is a few hundredth of percent lower than the frequency at that time, is set. On the other hand, in the process in which the frequency is decreased, when the amplitude of the output voltage of the resonant circuit does not reach the predetermined value or greater but reaches the initial frequency, an operation, in which the frequency is increased again, is repeated until the lamp is turned or a predetermined maximum time lapses.

Furthermore, Japanese Patent Application Publication No. 2004-327117 discloses that operation frequency of high-frequency voltage that is generated in an inverter circuit unit is set up to resonance frequency of a resonant circuit or frequency that is approximately odd times the frequency thereof, so that a high voltage pulse can be outputted, and a frequency sweep operation is carried out so that a high voltage pulse can be approximately uniformly outputted, wherein resonance boosting voltage is detected, and when it becomes approximately a target voltage value, the resonance boosting voltage is stopped, or operation frequency is fixed and an output having approximately a target voltage value continues for a fixed period, or when it becomes approximately the target voltage value, the operation frequency is swept in a direction opposite to the previous sweeping direction so that the output that is approximately the target voltage value or less continues for the a fixed period, or a resonance voltage detection unit is formed by a secondary winding of an inductor of the resonant circuit, or the resonance voltage detection unit is formed by a voltage dividing resistors connected to both ends of a capacitor of the resonant circuit, or a frequency sweep operation is controlled by a microprocessor.

Furthermore, Japanese Patent Application Publication No. 2005-520294 discloses that to perform automatic syntonization, as to syntonization based on automatic feedback of a third resonance, for example, an antenna circuit is used as a detecting unit for detecting an output of high voltage generated in a resonant circuit, and a feedback operation is carried out using a PLL circuit.

Japanese Patent Application Publication No. 2005-515589 discloses that, in an automatic syntonization unit, a feedback operation is carried out by using a VCO and a microprocessor, or voltage, current, and high voltage is fed back.

Furthermore, Japanese Patent Application Publication No. 2005-507554 discloses a ballast apparatus, in which the coefficient of self-induction of a coil, and a value of electrostatic capacity of a capacitor, and time jitter switching frequency are related to one another at a certain time during frequency change, so that at least the oddth harmonic frequency of the time jitter switching frequency approaches resonance frequency of the coil and the capacitor.

Furthermore Japanese Patent Application Publication No. 2005-507553 discloses a system in which a unit for measuring voltage of both ends of a discharge lamp is provided that a bridge, in which an igniter is being operated, performs a high order resonance operation, wherein the driving frequency of the bridge for performing resonance operation is swept before discharge starting, so that frequency is fixed when target voltage is reached, or a method in which after lighting, it is gradually shifted to a low frequency operation.

Furthermore, Japanese Patent Application Publication No. 2007-103290 discloses that a unit for measuring voltage generated in a resonant circuit is provided, so that frequency of a bridge is swept to perform a resonance operation at time of non-load, and the frequency is fixed when the target voltage is reached.

Furthermore, Japanese Patent Application Publication No. 2007-173121 discloses that the driving frequency of an inverter is changed continuously or stepwise from high frequency to low frequency, and based on a value obtained from resonance voltage, it is determined whether the resonance voltage reaches a second voltage level, and after a determination result of reaching the level is obtained, variable frequency is fixed so that the resonance voltage may be maintained to the second voltage level.

Furthermore, Japanese Patent Application Publication No. 2007-179869 discloses that, in a starting sequence of a discharge lamp, a frequency control circuit carries out a sweep operation, by which a frequency control signal is changed, while monitoring a syntonization degree signal, so that frequency is changed, starting from either an upper limit frequency or a lower limit frequency of a frequency variable oscillator, in a range that does not exceed the other frequency, and after completion of the sweep operation, the frequency control circuit determines a value of a frequency control signal with respect to resonance frequency of a resonant circuit, and inputs it into a frequency variable oscillator. In addition, the Japanese Patent Application Publication discloses that, after determining the value of the frequency control signal; the sweep operation covering a narrow range continues, to respond to drift of the resonance frequency, and further, the resonant circuit is configured to have the structure using a parallel resonant circuit, and a resonance inductor is configured to have a transformer structure so that the syntonization degree signal may be monitored.

Furthermore, Japanese Patent Application Publication No. 2008-027705 discloses that as a first voltage measurement unit, a resistor and a capacitor are connected to a secondary winding of a resonance inductor, to be used for feedback of an output of high voltage due to a resonant action.

Furthermore, Japanese Patent Application Publication No. 2008-269836 discloses that a capacitor and a resistor are connected to a secondary winding of a resonance inductor, to be used for feedback of an output of high voltage due to a resonant action, wherein resonance voltage is indirectly detected, and inverter driving frequency is fixed to frequency at the time when target voltage is met.

Thus, the proposals of the prior art are explained above, that is, a detection unit for detecting whether the resonant condition is realized, is provided, and the driving frequency of an inverter is set up to be in agreement with resonance frequency, so that high voltage is continuously generated. However, as described above, the detection unit for detecting whether the resonant condition is realized, and a means for controlling driving frequency of an inverter to be in agreement with resonant frequency are required, so that there is a problem of making the structure of the system complex and causing an increase in cost. Furthermore, since it is necessary to configure the resonant capacitor and the resonance inductor using high current capacity elements, there is a problem of a further increase in cost. Description of the discharge lamp lighting apparatus shown in FIG. 15 will be given below.

As mentioned above, since the LC resonance frequency is determined by a value of the product of the inductance of the resonance inductor (Lh') and the electrostatic capacity of the resonant capacitor (Ch'), a value of the electrostatic capacity of the resonant capacitor (Ch') must be made high, to make the inductance of the resonance inductor (Lh') small. Therefore, if the product of the inductance of the resonance inductor (Lh') and the electrostatic capacity of the resonant capacitor (Ch') is made small, the resonance frequency becomes very high so that it is difficult to operate the inverter (Ui'). However, in the case where the electrostatic capacity of the resonant capacitor (Ch') is made high, if a rise in sufficient voltage due to resonance phenomena is tried to be obtained, there is a problem in which current flowing through a series connection circuit of the resonance inductor (Lh') and the resonant capacitor (Ch'), i.e., resonance current, becomes very large.

This resonance current flows the whole circuit including not only the resonant capacitor (Ch') and the resonance inductor (Lh'), but also the power supply circuit (Ux') and the inverter (Ui'). Therefore, it is necessary to use high current rate elements for circuit elements of each part to be able to bear high resonance current, so that a increase in cost and an grow in size of apparatus cannot be avoided.

Even though the resonance frequency becomes very high, when an operation is performed according to a high order resonance, a method set forth below can be considered. That is, while operation frequency of the inverter (Ui') is held low, the electrostatic capacity of the resonant capacitor (Ch') is made small. However, as described above, since the resonance current flows through the inverter (Ui'), and especially an ON resistance of the switching element is comparatively large, a Q-value is small as a resonant capacitor (Ch'). Therefore, it turns out that a high order resonance cannot be used, since an attenuate of the resonance is intense.

Therefore, as long as LC series resonance is used, the inductance of the inductor (Lh') cannot be reduced, so that a great value is inevitably needed. However, the apparatus goes into a lighting steady state after initiation of the lamp lighting, and the resonance inductor having a large inductance may become a very obstructive existence in a stage where light of the lamp is used. Specifically, when, for example, the above-mentioned resonance inductor (Lh') or an igniter, which has a large inductance, is inserted in a downstream side of the inverter, there is a problem of acceleration of inconvenient phenomena, such as overshoot of lamp flux or vibration at time of the polarity reversals, as mentioned above.

To avoid such a problem of the LC series resonance, it is possible to consider a method of driving a lamp by direct current at least at start-up time, without using the LC series resonance. For example, Japanese Patent No. 4244914 proposes that no-load opening voltage is impressed thereto by direct current, during which an igniter operation is performed, and after a certain period, it is changed to an alternating current operation.

As proposed in Patent No. 4244914, when a direct-current drive is simply carried out after the electric discharge is started by an igniter at time of start-up, without using the LC series resonance or without having a special support mechanism against heating of an electrode at time of glow discharge, since voltage of the mechanism, which accelerates a shift from glow discharge to arc discharge, is as high as the no-load opening voltage to be impressed, it is necessary for a power supply circuit to generate high no-load opening voltage of, for example, approximately 300 V. In such a case, since the inverter is provided in a downstream side of the power supply circuit, it is necessary to select high voltage capacity elements, as elements, which forms the inverter. However, since the higher the cost is in switching elements, such as FETs, the higher the voltage capacity is, and in addition, since the loss becomes large, the cost for a measure against heat dissipation is needed, so that the total cost become high, and there is a problem in which reduction in size and weight cannot be made.

Further, as proposed in Patent No. 4244914, when a direct-current drive is simply carried out at start-up time, it is to be noted that there is a possibility that the lamp is damaged unless it is carefully controlled. When main electric discharge starts at time of initiation, if concretion/coagulation, such as mercury, does not adhere to an electrode, which serves as a cathode, and which is one of the electrodes (E1, E2), glow discharge starts. When such concretion/coagulation adheres thereto, electric discharge like arc discharge, which is called field emission, is generated, and when the condensation and congelation evaporates and is depleted due to electric discharge, the discharge shifts to glow discharge. And if the electrode reaches temperature, which is sufficient to cause arc discharge by thermoelectronic emission due to the glow discharge, the discharge shifts to the arc electric discharge.

Since this situation is the same in either a direct current lamp driving method or an alternating current lamp driving method, it turns out that occurrence of transition between the state of high voltage glow discharge and the state of low voltage field emission or arc discharge, is indispensable. However, as described in Patent No. 4244914, in the case where direct-current drive is performed at least at start-up time, since electric charges stored in a smoothing capacitor of a power supply circuit (Ux') flow through the discharge lamp as inrush current in the transition from the state of the high voltage glow discharge to the state of the low voltage field emission or arc discharge, the lamp may be damaged unless the inrush current is carefully controlled not become excessive.

In this view, as in the case where LC series resonance is used, when an inductor is in series inserted in a lamp and a high frequency waveform operation of the inverter (Ui') is carried out, since the impedance of the inductor is high, there is an advantage that a peak value of inrush current can be suppressed, so that possibility of damaging the lamp can be suppressed.

As in the above-described case where LC series resonance is used, when an inductor is in series inserted in a lamp and a high frequency waveform operation of the inverter (Ui') is carried out, there is an advantage that development occurs in a stage of the transition from occurrence of breakdown in the lamp to arc discharge. However, to realize a stable lighting state of a discharge lamp lighting apparatus, after dielectric breakdown is generated in the lamp, and transition to the arc discharge is completed, there remains a problem in which it is necessary to complete the transition of driving frequency of the inverter from high resonance frequency to low frequency in a final stable lighting state.

For example, although in Japanese Patent Application Publication No. 2007-242586, a system in which while the lamp is driven by direct current or alternating current at start-up time, high voltage required for initiation of the lamp is highly frequently superimposed thereon, is proposed, no reference is made to a mode of how to decrease frequency to the low frequency in the final stable lighting state, in the case where it is started by alternating current.

Conventionally, as technique for switching the driving frequency of such an inverter between frequency at time of high-voltage impression to a discharge lamp and that at a stabile period thereof, there is technology, in which a function of resonance start up for certainly shifting to arc discharge from a glow discharge is included in the process; or technology, in which a function for completing an asymmetrical electric discharge phenomenon in which current flows only in one side direction of the discharge lamp electrode for a short time as seen in an initiation system for applying high frequency, and a function for stably carrying out transition and lighting in both directions of the discharge lamp electrode while the damage to the electrode is suppressed, are included in the process.

To improve them, a method of effectively switching or changing the frequency of an inverter, or a method of switching a value of current applied to a discharge lamp, have been proposed conventionally.

Japanese Patent Application Publication No. H03-167795 discloses that when start-up of discharge in a discharge lamp is detected, operation frequency of switching elements is gradually changed from frequency at time of non-load to frequency at time of lighting, wherein when asymmetrical electric discharge occurs, passage of extreme overcurrent in alighting direction is prevented not to drop frequency rapidly.

Furthermore, Japanese Patent Application Publication No. H04-121997 discloses that after a lamp is initiated, the frequency is changed to low frequency from resonance frequency or the frequency close thereto, or the frequency is continuously decreased.

Furthermore, Japanese Patent Application Publication No. H04-342990 discloses that at start-up time of a discharge lamp, an inverter is driven at frequency close to resonance frequency in an LC series resonant circuit, and if an output of a lamp current detection unit exceeds a predetermined value, an output or frequency of the inverter is switched to a decreased and predetermined value.

Furthermore, Japanese Patent Application Publication No. H07-169583 discloses that a frequency control unit for changing frequency of output voltage of a direct current/alternating current conversion circuit is provided, wherein when a light-out state of a discharge lamp is judged by a lighting judgment unit, the frequency control unit increases frequency of the output voltage of the direct current/alternating current conversion unit to a value that is sufficient to cause series resonance by an inductor and a capacitor, and moreover, when the lighting state of a discharge lamp is judged by the lighting judgment unit, the frequency control unit decreases the frequency of the output voltage of the direct current/alternating current conversion circuit.

Furthermore, Japanese Patent Application Serial No. H07-230882 discloses that in a predetermined period after start-up, an inverter unit is continuously operated at frequency that is resonance frequency or more of a series resonant circuit, and that is close to the resonance frequency.

Furthermore in Japanese Patent Application Publication No. H08-124687 discloses that a resonant circuit makes a full bridge operate at high order resonance frequency only at time of non-load, and when a lamp is turned on, a frequency switching control circuit impresses voltage of low frequency to the lamp.

Furthermore, Japanese Patent Application Publication No. H11-265796 discloses that when it is judged that a discharge lamp is shifted to a lighting state, it is changed to a predetermined value in which frequency is decreased.

Furthermore, Japanese Patent Application Publication No. 2004-265707 discloses that a full bridge is operated at high order resonance frequency, using an LC resonance circuit, and after lighting, voltage of low frequency is impressed to a lamp, wherein a period during which a resonant circuit generates high voltage, and a period during which it outputs direct current voltage or a different period are repeated by turns.

Furthermore, Japanese Patent Application Publication No. 2008-171742 discloses that after a predetermined time lapses from time when a lamp is started, it is determined that the electric discharge occurs at a base portion or at a tip portion, wherein when it is the electric discharge at a tip portion, the operation is changed from a high frequency wave operation to a low frequency steady operation, but when it is the electric discharge at a base portion, the high frequency wave operation continues.

Furthermore, Japanese Patent Application Publication No. 2007-005260 discloses that if a judging circuit for judging that full wave electric discharge or asymmetrical electric discharge occurs in a discharge lamp, if it judges that it is the full wave electric discharge, constant current, which is set up so that the discharge lamp is made to shift to a stable lighting state within a predetermined period, is supplied to the discharge lamp, and on the other hand, if the judging circuit judges it is the half wave discharge, a switching unit switches current which flows between both electrodes so that the current with a peak value larger than the above-mentioned constant current is supplied to the discharge lamp DL.

SUMMARY

The present invention relates to a discharge lamp lighting apparatus for lighting a discharge lamp in which a pair of electrodes for main discharge face each other that comprises a power supply circuit that supplies electric power to the discharge lamp; an electric supply control circuit that controls the power supply circuit; an inverter that is provided in a downstream side of the power supply circuit and that performs polarity reversals of voltage to be impressed to the discharge lamp; a periodic drive circuit for generating an inverter drive signal, which is a periodic signal for carrying out a periodic drive of the inverter; a transformer, which has a primary side winding and a secondary side winding; and an intermittent voltage applying unit for performing a voltage impression drive to the primary side winding, wherein the secondary side winding of the transformer is inserted in a path that connects an output of the inverter and the electrodes for main discharge of the discharge lamp to each other, so that a voltage generated in the secondary side winding can be superimposed on an output voltage of the inverter and is impressed between the electrodes of the discharge lamp, wherein in a starting sequence of the discharge lamp, while the periodic drive circuit generates the inverter drive signal so that the frequency of the inverter becomes a start-up initial frequency that is higher than stable lighting frequency, the electric supply control circuit controls the power supply circuit to output no-load opening voltage, which is voltage sufficient to maintain electric discharge of the discharge lamp, wherein the periodic drive circuit generates the inverter drive signal so that the frequency of the inverter gradually decreases until reaching a first threshold frequency from the start-up initial frequency, wherein when the frequency of the inverter reaches the first threshold frequency, the periodic drive circuit generates the inverter drive signal so that the frequency of the inverter becomes the stable lighting frequency, and wherein the electric supply control circuit controls the power supply circuit to output current, which is sufficient to maintain electric discharge of the discharge lamp.

Further, when the frequency of the inverter reaches the first threshold frequency, before the periodic drive circuit generates the inverter drive signal so that the frequency of the inverter becomes the stable lighting frequency, the periodic drive circuit may generate the inverter drive signal so that the frequency of the inverter becomes the second threshold frequency that is lower than the first threshold frequency, and an operation where the inverter drive signal is generated to gradually decrease the frequency of the inverter until the frequency of the inverter reaches the stable lighting frequency.

Furthermore, along with an operation of the periodic drive circuit, which generates the inverter drive signal to gradually decrease the frequency of the inverter until the frequency of the inverter reaches the first threshold frequency from the start-up initial frequency, the electric supply control circuit may control the power supply circuit to output voltage, which gradually decreases until the voltage reaches predetermined voltage that is lower than the no-load opening voltage.

Furthermore, a capacitor may be connected to the transformer, in which electric capacity of the capacitor is set up so that free oscillation frequency of voltage generated in the secondary side winding is 3 MHz or less, and in a starting period of the discharge lamp, there may be a period in which the intermittent voltage applying unit continues a voltage impression drive even after the voltage impression drive is performed at average frequency of 8,000 times/second or more whereby electric discharge of the discharge lamp is started.

Furthermore, a total of inductance components along with a path of main discharge current of the discharge lamp in a downstream side from the inverter may be set to 160 μH or less.

Furthermore, the intermittent voltage applying unit may comprise a power supply for a voltage impression drive, and a voltage impression drive switching elements, and wherein a voltage is impressed to the primary side winding in an ON state of the voltage impression drive switching element.

BRIEF DESCRIPTION OF THE DRAWINGS

Other features and advantages of the present discharge lamp lighting apparatus will be apparent from the ensuing description, taken in conjunction with the accompanying drawings, in which.

DESCRIPTION

Figure 1:
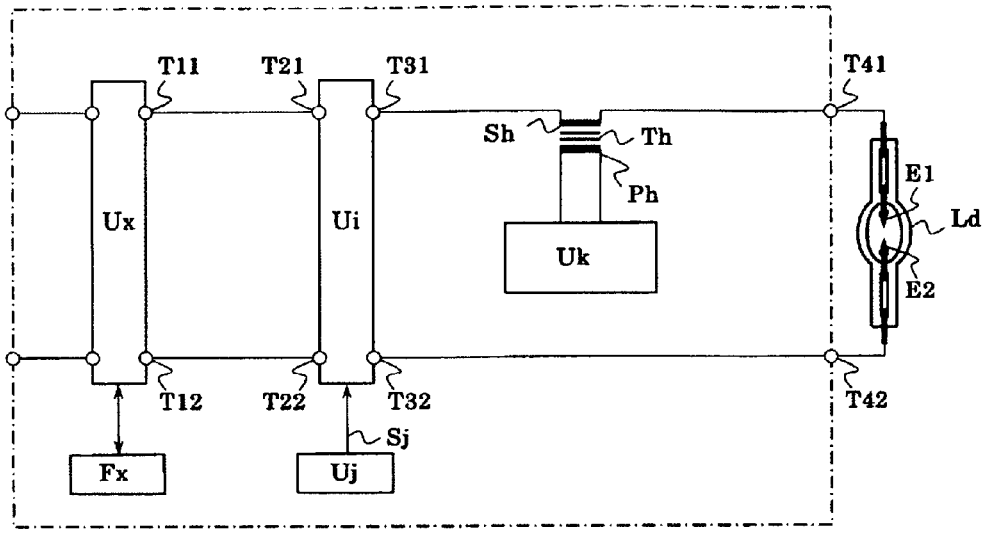
FIG. 1 is a simplified block diagram showing a discharge lamp lighting apparatus according to an embodiment of the present invention.

As described above, when a resonance start-up method is used, a detection unit for detecting whether the resonance condition is realized and a unit for controlling driving frequency of an inverter to be in agreement with resonance frequency are required. Further, since it is necessary to form a resonance capacitor and a resonance inductor by elements with high current resistance, there is a problem in which the cost increases. On the other hand, as described above, in the case of the system in which a direct current drive is performed at start-up time, elements, which have high voltage resistance, are required for switching elements of the inverter, thereby rising cost as a whole, and it is disadvantageous in terms of reduction in size and weight. Furthermore, there is a problem that there is a possibility of damaging the lamp unless it is controlled carefully.

As a means for solving all of these problems, a system, which is driven to start an operation by alternating current of high frequency without using LC resonance, can be considered. However, subject matter to be solved in the system, is that a step for shifting the drive frequency of the inverter from high frequency to low frequency in a final stable lighting state, must be safely and certainly completed. Even if transition to a glow discharge state or an arc discharge state occurs, there is always a possibility that electric discharge goes out, until all electric discharge substance enclosed in the lamp evaporates. For example, in case of a high pressure mercury lamp in which mercury is enclosed, although arc discharge, which is called field emission, occurs from liquid mercury adhering to an electrode, which is a cathode, it will try to return to the glow discharge when the liquid mercury is depleted. In such a case, since voltage of the glow discharge is higher than arc discharge, if a power supply circuit cannot promptly supply such voltage, which is sufficient to maintain the glow discharge, electric discharge may go out. There is also a way of devising a measure for enhancing the capability of such a power supply circuit so that the probability of occurrence of this phenomenon may become zero. However, it is not realistic since cost increases in general. Therefore, it is necessary to consider the structure capable of promptly resuming resonance initiation when the electric discharge goes out.

Moreover, even if a breakdown occurs in a lamp due to resonance initiation, thereby succeeding in starting electric discharge, unless shifting to arc discharge from glow discharge can be completed for a short period in both directions of high frequency alternating current, a period, during which a spattering phenomenon on an electrode of a discharge lamp arises, becomes long, so that the electrodes deteriorate and blackening is caused. As a result, there is a possibility of shortening a life span thereof. In particular, when the so-called asymmetrical electric discharge where electric discharge in one of the current directions does not shift to arc discharge, continues over a long period, for example, until after shifting to low frequency, there may be adverse effects on a life span thereof.

It is an object of the present invention to offer a discharge lamp lighting apparatus capable of securing lighting nature of a discharge lamp at start-up time by facilitating elimination of a state of asymmetrical electric discharge.

According to the present invention, a discharge lamp lighting apparatus for lighting a discharge lamp (Ld) in which a pair of electrodes (E1, E2) for main discharge is arranged to face each other, comprises a power supply circuit (Ux) that supplies electric power to the discharge lamp (Ld), an electric supply control circuit (Fx) that controls the power supply circuit (Ux), an inverter (Ui), which is provided in a downstream side of the power supply circuit (Ux), and which performs polarity reversals of voltage to be impressed to the discharge lamp (Ld), a periodic drive circuit (Uj) that generates an inverter drive signal (Sj) that is a periodic signal for carrying out the periodic drive of the inverter (Ui), a transformer (Th), which has a primary side winding (Ph) and a secondary side winding (Sh), an intermittent voltage applying unit (Uk) for performing a voltage impression drive to the primary side winding (Ph), wherein the secondary side winding (Sh) of the transformer (Th) is inserted in a path that connects an output of the inverter (Ui) and the electrodes for main discharge of the discharge lamp (Ld) to each other, so that voltage generated in the secondary side winding (Sh) is superimposed on output voltage of the inverter (Ui), to be impressed between the electrodes (E1, E2) of the discharge lamp (Ld), and wherein in a starting sequence of the discharge lamp (Ld), while the periodic drive circuit (Uj) generates the inverter drive signal (Sj) so that the frequency of the inverter (Ui) may become start-up initial frequency (fini) that is higher than stable lighting frequency (fstb), the electric supply control circuit (Fx) controls the power supply circuit (Ux) to output no-load opening voltage (Vop) that is voltage sufficient to maintain electric discharge of the discharge lamp (Ld), wherein the periodic drive circuit (Uj) generates the inverter drive signal (Sj) so that the frequency of the inverter (Ui) gradually decreases until reaching first threshold frequency (fj1) from the start-up initial frequency (fini), wherein when the frequency of the inverter (Ui) reaches the first threshold frequency (fj1), the periodic drive circuit (Uj) generates the inverter drive signal (Sj) so that the frequency of the inverter (Ui) becomes the stable lighting frequency (fstb), and wherein the electric supply control circuit (Fx) controls the power supply circuit (Ux) to output current that is sufficient to maintain electric discharge of the discharge lamp (Ld).

In the discharge lamp lighting apparatus according to the present invention, when the frequency of the inverter (Ui) reaches the first threshold frequency (fj1), before the periodic drive circuit (Uj) generates the inverter drive signal (Sj) so that the frequency of the inverter (Ui) may become the stable lighting frequency (fstb), the periodic drive circuit (Uj) generates the inverter drive signal (Sj) so that the frequency of the inverter (Ui) becomes second threshold frequency (fj2) that is lower than the first threshold frequency (fj1), and an operation, in which the inverter drive signal (Sj) is generated to gradually decrease the frequency of the inverter (Ui) until the frequency of the inverter (Ui) reaches the stable lighting frequency (fstb), is inserted.

In the discharge lamp lighting apparatus according to the present invention, along with an operation of the periodic drive circuit (Uj), in which the inverter drive signal (Sj) is generated to gradually decrease the frequency of the inverter (Ui) until the frequency of the inverter (Ui) reaches the first threshold frequency (fj1) from the start-up initial frequency (fini), the electric supply control circuit (Fx) controls the power supply circuit (Ux) to output voltage, which gradually decreases until the voltage reaches predetermined voltage (Vo2) that is lower than the no-load opening voltage (Vop).

In the discharge lamp lighting apparatus according to the present invention, a capacitor (Ch) is connected to the transformer (Th), wherein electric capacity of the capacitor (Ch) is set up so that free oscillation frequency of voltage generated in the secondary side winding (Sh) is 3 MHz or less, and wherein, in a starting period of the discharge lamp (Ld), there is a period in which the intermittent voltage applying unit (Uk) continue to perform a voltage impression drive even after the voltage impression drive is performed at average frequency of 8,000 times/second or more, whereby electric discharge of the discharge lamp (Ld) is started.

In the discharge lamp lighting apparatus according to the present invention, a total of inductance components along with a path of main discharge current of the discharge lamp (Ld) in a downstream side from the inverter (Ui) is set to 160 μH or less.

In the discharge lamp lighting apparatus according to the present invention, the intermittent voltage applying unit (Uk) comprises a power supply (Mh) for a voltage impression drive, and a voltage impression drive switching elements (Kh), wherein voltage is impressed to the primary side winding (Ph) in an ON state of the voltage impression drive switching element (Kh).

dfaAccording to the present invention, it is possible to offer a discharge lamp lighting apparatus in which cancellation of a state of asymmetrical electric discharge is facilitated, thereby securing reliable lighting nature of a discharge lamp at start-up time.

Description of one of embodiments of a discharge lamp lighting apparatus according to the present invention will be given below, referring to FIG. 1, wherein FIG. 1 is a schematic block diagram thereof. A power supply circuit (Ux), which is made up of, for example, a step down chopper or boost chopper etc. type switching circuit, outputs suitable voltage and current, according to a state of a discharge lamp (Ld) or according to lighting sequence thereof. An inverter (Ui) made up of a full bridge circuit etc., converts the output voltage of the power supply circuit (Ux) to, for example, alternating current voltage, which is periodically reversed, and outputs it therefrom, so that the voltage is impressed to a pair of electrodes (E1, E2) for main discharge of the discharge lamp (Ld), through a transformer (Th). An intermittent voltage applying unit (Uk) is connected to a primary side winding (Ph) so that a voltage impression drive can be intermittently carried out to the primary side winding (Ph) of the transformer (Th).

In addition, non-load open circuit voltage impressed to the lamp at start-up is typically approximately 200 V, the lamp voltage at time of glow discharge is typically approximately 100-200 V, and the lamp voltage immediately after transition to arc discharge is typically approximately 10 V. At the time of glow discharge and arc discharge, the power supply circuit (Ux) is controlled so that the flowing current may not exceed a predetermined limit current value.

At start-up time, while the power supply circuit (Ux) outputs the voltage for impressing release voltage in no-load state to the discharge lamp (Ld), the intermittent voltage applying unit (Uk) highly frequently performs a voltage impression drive to the primary side winding (Ph). As to frequency (repetition) of the voltage impression drive, it is suitable to perform such a voltage impression drive at average frequency of, for example 8,000 times/second or more. In addition, the reason why the frequency of the voltage is determined by not frequency but average repetition, is that the voltage impression drive does not always need to be periodically performed, and there is no problem even the voltage impression drive may be performed by the intermittent drive, which is erratically (not periodically) performed.

In the transformer (Th), voltage, which is transformed according to turns ratio, is induced in the secondary side winding (Sh) by the voltage which is impressed to or which is generated in the primary side winding (Ph). During a period of the voltage impression drive, when excitation energy is stored in the transformer (Th) and a voltage impression drive is completed, the stored excitation energy is released by a flyback action of the transformer (Th) so that high voltage is generated in the secondary side winding (Sh). The high voltage, which is generated in the secondary side winding (Sh), is for example, about 2 kV-5 kV in peak voltage, and this voltage gradually decreases while oscillating.

By repetition of such a voltage impression drive performed by the intermittent voltage applying unit (Uk), a state where oscillating high voltage, which is outputted from the secondary side winding (Sh), is superposed on voltage outputted from the power supply circuit (Ux), in the electrodes (E1, E2) for the main discharge of the discharge lamp (Ld), is realized almost in a continuous fashion, so that a breakdown is generated in the electrical discharge space of the discharge lamp (Ld), whereby main discharge of the lamp can be started.

Figure 2:
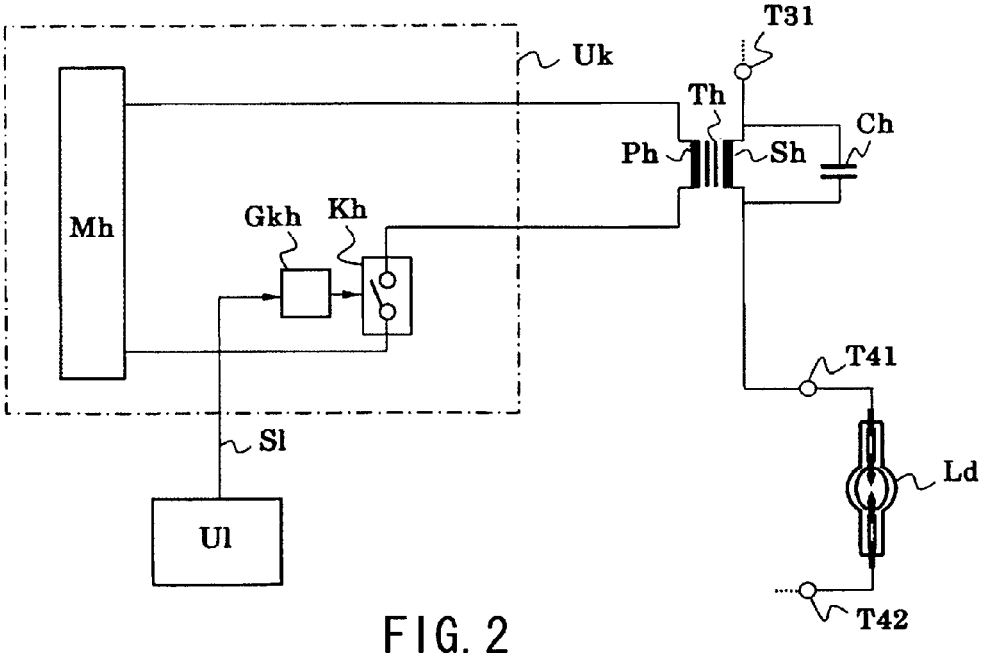
FIG. 2 is a schematic view of part of the structure of a discharge lamp lighting apparatus according to an embodiment of the present invention.

FIG. 2 shows an example of the structure of the intermittent voltage applying unit (Uk) shown in FIG. 1, which can be used with the discharge lamp lighting apparatus according to the present invention. The intermittent voltage applying means (Uk) comprises a power supply (Mh) for a voltage impression drive and a voltage impression drive switching element (Kh), which is made up of a MOSFET etc., wherein the power supply (Mh) and the voltage impression drive switching element (Kh) are in series connected to each other. When the voltage impression drive switching element (Kh) is in an ON state, the primary side winding (Ph) can be driven by the voltage impression drive. The voltage impression drive switching element (Kh) is controlled through a gate driving circuit (Gkh) based on an intermittent drive control signal (Sl) from an intermittent drive control circuit (Ul).

To maintain pulse width of the high voltage impressed to the discharge lamp (Ld), to a certain lower limit or greater, that is, to provide restriction to an upper limit value of oscillation frequency of the voltage oscillation of the secondary side winding (Sh), it is suitable to connect a capacitor (Ch), which has suitable electrostatic capacity, to the secondary side winding (Sh) of the transformer (Th) in parallel. Moreover, it is suitable that the above-mentioned upper limit value of the oscillation frequency of the voltage oscillation of the secondary side winding (Sh) is set to 3 MHz.

When electric discharge is not generated in the discharge lamp (Ld), or when the discharge lamp (Ld) is not connected to the discharge lamp lighting apparatus, the frequency of the voltage oscillation of the secondary side winding (Sh) is the frequency of the voltage oscillation generated in the secondary side winding (Sh) at intervals of the voltage impression drive of the intermittent voltage applying unit (Uk), and is normally considered as resonance frequency of an LC resonance circuit that is mainly made up of the electrostatic capacity of the capacitor (Ch) and the inductance of the secondary side winding (Sh), and it is calculated depending on the product of these electrostatic capacity and inductance. However, when some capacitor components, such as floating electrostatic capacity, are contained in the secondary side winding (Sh), the calculation result of the above-mentioned resonance frequency is corrected.

Figure 3:
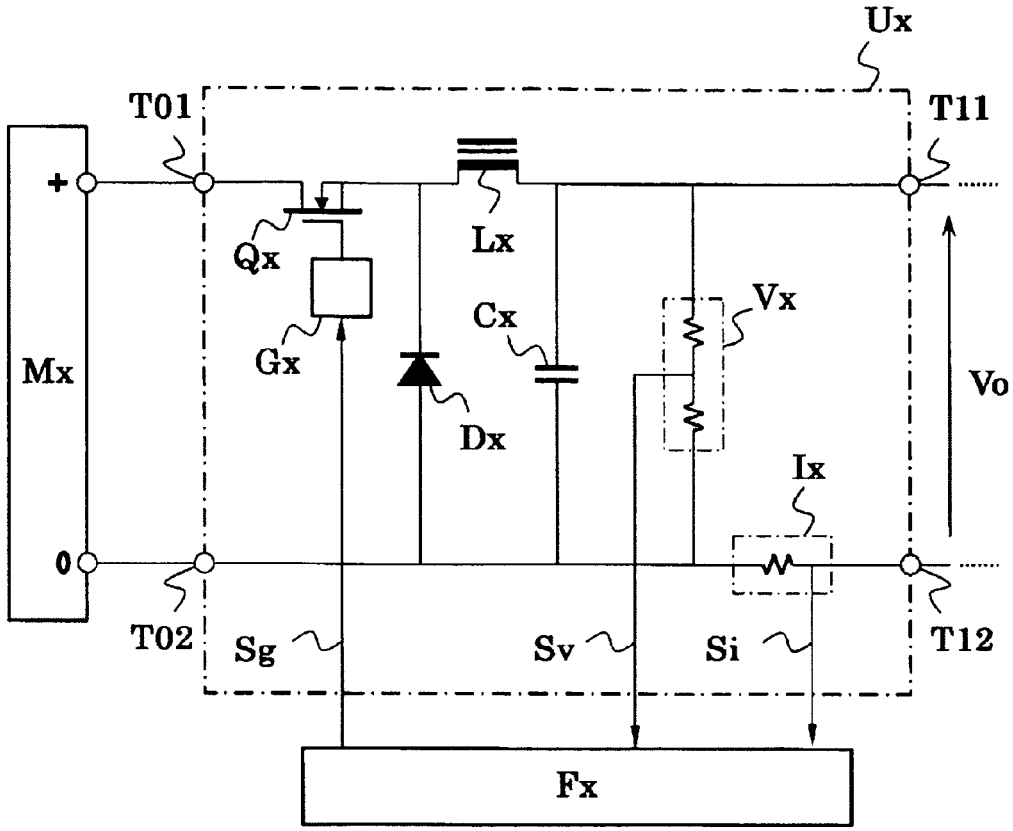
FIG. 3 is a schematic view of part of the structure of a discharge lamp lighting apparatus according to an embodiment of the present invention.

At a moment where the voltage impression drive switching element (Kh) is in an ON state, in the case where there is a possibility that current for charging the capacitor (Ch) connected to the secondary side winding (Sh) may flow like surge through the voltage impression drive switching element (Kh) and may damage it, current limiting elements, such as a resistor and a coil may be inserted in series therein with the voltage impression drive switching element (Kh). The intermittent drive control circuit (Ul) may be configured by a simple multivibrator, which oscillates at desired frequency that is average frequency of the voltage impression drive performed by the intermittent drive control signal (Sl). After transition to the arc discharge of the lamp is completed, in a starting sequence of the discharge lamp, the intermittent drive control circuit (Ul) may be configured to stop generating the intermittent drive control signal (Sl). FIG. 3 shows a concrete example of the power supply circuit (Ux), which can be used, in the discharge lamp lighting apparatus according to the present invention. The power supply circuit (Ux) based on a step down chopper circuit is operated in response to supply of voltage from a DC power source (Mx), such as a PFC etc., and adjusts electric supply to the discharge lamp (Ld). The power supply circuit (Ux) is configured so that current from the DC power source (Mx) is turned on and off by a switching element (Qx), such as FET, so that a smoothing capacitor (Cx) is charged through a choke coil (Lx), and this voltage is impressed to the discharge lamp (Ld), thereby passing current through the discharge lamp (Ld). In addition, while in a period when the switching element (Qx) is in an ON state, the smoothing capacitor (Cx) is directly charged and current is supplied to the discharge lamp (Ld) that is a load, by the current that flows through the switching element (Qx), energy is stored in a choke coil (Lx) in the form of magnetic flux, and in a period when the switching element (Qx) is in an OFF state, the smoothing capacitor (Cx) is charged and current is supplied to the discharge lamp (Ld) through a flywheel diode (Dx), by the energy stored in the choke coil (Lx) in the form of magnetic flux. In addition, the "resting state of the power supply circuit (Ux)" shown in FIG. 1, which is explained above in connection with FIG. 2, means a state where the switching element (Qx) stops in an OFF state. In the step down chopper type power supply circuit (Ux), electric power supply to the discharge lamp can be adjusted by a ratio of a period of an ON state of the switching element (Qx) to an operation cycle of the switching element (Qx), that is, a duty cycle ratio. Here, a gate driving signal (Sg), which has a certain duty cycle ratio, is generated by an electric supply control circuit (Fx), and turning on and off of the current from the DC power source (Mx) is controlled by controlling a gate terminal of the switching element (Qx) through a gate driving circuit (Gx).

Lamp current that flows between the electrodes (E1, E2) of the discharge lamp (Ld), and lamp voltage generated between the electrodes (E1, E2) are detected by an electric supply current detection unit (Ix) and an electric supply voltage detection unit (Vx), respectively. In addition, a shunt resistor is used for the electric supply current detection unit (Ix), and the electric supply voltage detection unit (Vx) can be easily realized by using a voltage dividing resistor.

The electric supply current detection signal (Si) from the electric supply current detection unit (Ix) and an electric supply voltage detection signal (Sv) from the electric supply voltage detection unit (Vx) are inputted into the electric supply control circuit (Fx). In the period when lamp current does not flow at start-up time of the lamp, the electric supply control circuit (Fx) generates the gate driving signal (Sg) in a feedback manner to output a certain voltage, thereby impressing non-load open circuit voltage to the lamp. Moreover, when a lighting operation of the lamp starts so that discharge current flows, the electric supply control circuit (Fx) generates the gate driving signal (Sg) in a feedback manner so that target lamp current may be outputted. The target lamp current is based on a value by which electric power applied to the discharge lamp (Ld) turns into predetermined electric power depending on voltage of the discharge lamp (Ld). However, since the voltage of the discharge lamp (Ld) is low immediately after the start-up so that rated power cannot be supplied, the target lamp current is controlled not to exceed a constant limit value, which is called initial limit current. The voltage of the discharge lamp (Ld) rises with a temperature rise, and if current required for predetermined electric power impression turns into the above-mentioned initial limit current or less, it shifts to a state where the predetermined electric power impression can be smoothly realized.

Figure 4:
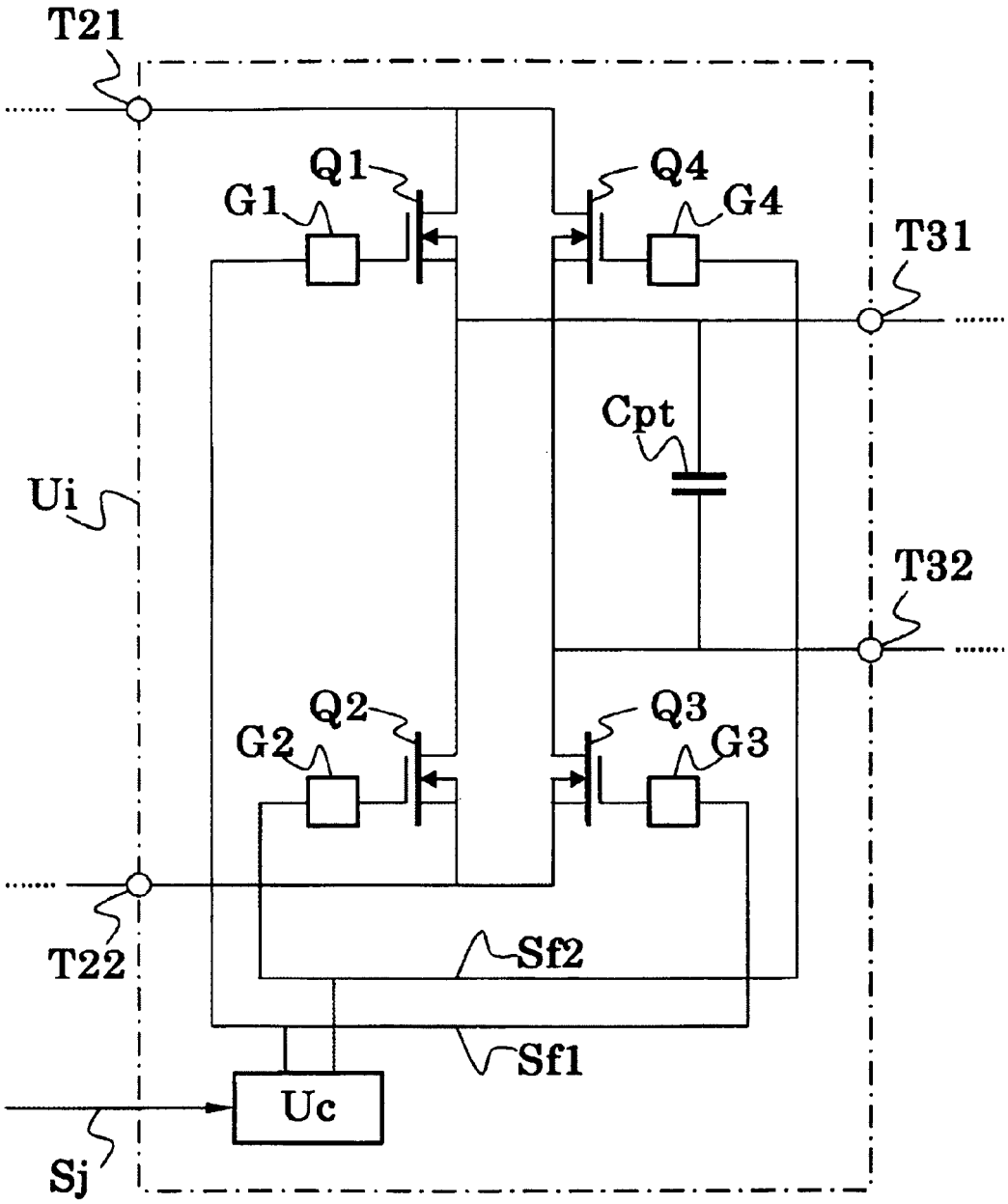
FIG. 4 is a schematic view of part of the structure of a discharge lamp lighting apparatus according to an embodiment of the present invention.

FIG. 4 is a schematic diagram showing of an embodiment of an inverter (Ui), which can be used, in a discharge lamp lighting apparatus according to the present invention. The inverter (Ui) is configured by a full bridge circuit, using switching elements (Q1, Q2, Q3, and Q4), which are respectively made up of FETs. Each switching element (Q1, Q2, Q3, and Q4) is driven by each gate driving circuit (G1, G2, G3, and G4), and is controlled through the gate driving circuit (G1, G2, G3, and G4) by the inverter control signals (Sf1, Sf2) generated by an inverter driving circuit (Uc) of the inverter so that when the switching element (Q1) and the switching element (Q3) that are in a relationship of diagonal elements are in an ON state, the switching element (Q2) and the switching element (Q4) that are in relationship of diagonal elements are maintained in an OFF state, and conversely, when the switching element (Q2) and the switching element (Q4) that are in relationship of diagonal elements are in an ON state, the switching element (Q1) and the switching element (Q3) are in an OFF state. When the above-mentioned two phases are switched, a period, which is called a dead time in which all the switching elements (Q1, Q2, Q3, and Q4) are turned off, is inserted.

In addition, in the case where the switching elements (Q1, Q2, Q3, and Q4) are respectively formed of MOSFETs, a parasitism diode whose forward direction is from a source terminal toward a drain terminal is built in each element itself (not shown), but in case of a bipolar transistor etc., in which a parasitism diode does not exist, since there is a possibility that the element may be damaged by generation of reverse voltage at the above-mentioned switching time or during the dead time, when induced current resulting from the inductance component that exists in the downstream side of the inverter (Ui) flows, it is desirable to connect a diode equivalent to a parasitism diode in reverse-parallel. The switching elements (Q1, Q2, Q3, Q4) are driven by the inverter drive circuit (Uc), which receives the inverter driving signal (Sj) outputted from the periodic driving circuit (Uj).

In addition, to effectively carry out energy injection to the lamp in a glow discharge state, it is necessary for voltage of the discharge lamp lighting apparatus to exceed the glow discharge voltage of the lamp. As described above, after the main discharge starts, in the case where condensation/congelations, such as mercury, does not adhere to an electrode, which is one of the electrodes (E1, E2) of the discharge lamp (Ld), and which serves as a cathode, glow discharge starts. In such a case where the concretion/coagulation adheres thereto, arc discharge, which is called field emission, occurs, and if such concretion/coagulation is evaporated and depleted, the discharge shifts to glow discharge. And, when the electrode reaches temperature, which is sufficient to produce arc discharge by the thermionic emission due to the glow discharge, it shifts to arc discharge.

To appropriately perform the shift to such arc discharge, suitable energy injection needs to be performed to the lamp within a period of the glow discharge. When energy injection runs short, there is a possibility that main discharge may go out. In such a case, it is necessary to retry an operation from breakdown by a starter, and when it repeats such retry, there is a possibility that the lamp is damaged. Conversely, when the energy injection is excessive, there is also a possible that the lamp is damaged, wherein this damage is observed as blackening of a lamp bulb. The glow discharge is accompanied by a phenomenon, in which cations are accelerated by an electric field generated by comparatively high voltage, and collide with a cathode. Since a cation is heavier than an electron, when the cations collie with the electrode, a phenomenon in which electrode material, such as tungsten, is blown off, that is, sputtering occurs, whereby the electrode material, which is blown off, adheres to an inner surface of the lamp bulb.

Although energy is determined by the product of electric power and time, such a damage in the case where energy injection is excessive is caused only when electric power is too large. Therefore, as long as applied power is a suitable in magnitude, injected energy increases monotonically with passage of time, and the temperature of the electrode increases therewith so that the glow discharge ends to shift to arc discharge with low voltage, whereby the lamp itself automatically stops energy injection due to glow discharge, so that the harmful blackening of the lamp bulb does not occur, since an automatic control mechanism operates to avoid an excessive implant energy. However, it is assumed that when applied power is excessive, the electrode is momentarily attacked by a lot of cations without time for the automatic control mechanism to operate before completing the shift to arc discharge, and since much electrode material; which is blown off, adheres to the inner surface of the lamp bulb, a serious blackening of the lamp bulb would occur.

The periodic or intermittent voltage impression drive performed by the intermittent voltage applying unit (Uk) is very suitable to effectively perform energy injection to the lamp in such a glow discharge state. Since the periodic or intermittent voltage impression drive by the intermittent voltage applying unit (Uk) is performed by energy injection in a pulse pattern, instead of passage of time of the glow discharge, the number of energy pulses is increased one by one to wait until required and sufficient energy is acquired, and then transition to arc discharger occurs as an inevitable event.

As described above, since the impedance of the lamp is small in a period of glow discharge, high voltage is not generated in the secondary side winding (Sh) by a flyback action of the transformer (Th). However, if relation between voltage of the power supply (Mh) for a voltage impression drive and the turns ratio of the transformer (Th) is set up so that voltage, which is induced in the secondary side winding (Sh) may become higher than glow discharge voltage during a period of the voltage impression drive of the primary side winding (Ph) by the intermittent voltage applying unit (Uk), which is called a period of a forward operation, even if the voltage which the power supply circuit (Ux) outputs is lower than the voltage of glow discharge to impress no-load open circuit voltage to the lamp, energy injection to the lamp in a glow discharge state can be effectively performed.

However when the frequency of the voltage impression drive performed by the intermittent voltage applying unit (Uk) is too low, since a rise in temperature of the electrode is suppressed by thermal radiation produced in a period from a time point of energy injection in form of the energy pulse to a time point of the following energy pulse injection, it is impossible to reach the electrode temperature that is sufficient to produce arc discharge caused by thermionic emission. Therefore, there is a lower limit as to the frequency of the voltage impression drive. In the above situation, 8,000 times/second is experimentally obtained, and is the lower limit of the average frequency of the voltage impression drive performed by the intermittent voltage applying unit (Uk). Similarly, the 3 MHz, which is experimentally obtained and which is the upper limit of a free oscillation frequency as to voltage oscillation of the secondary side winding (Sh), is a limit value for avoiding a situation where time width of half wave of the sinusoidal free-oscillation waveform of voltage becomes too small, so that main discharge of the lamp cannot be effectively started.

Figure 5:
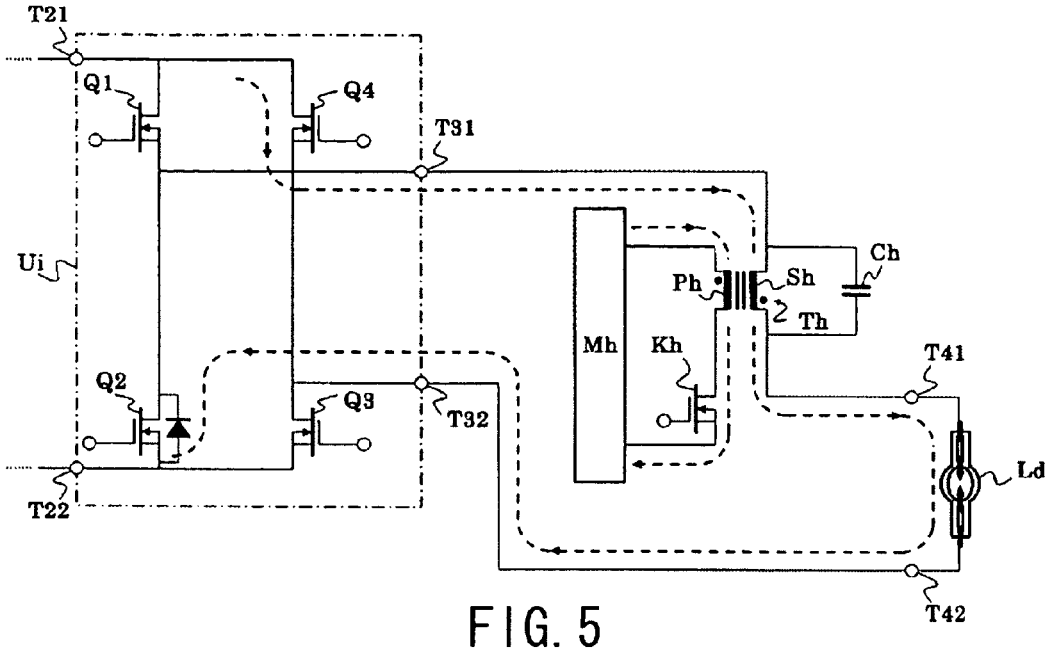
FIG. 5 is a schematic view of part of the structure of a discharge lamp lighting apparatus according to an embodiment of the present invention.

FIG. 5 is a schematic diagram of part of the structure of a discharge lamp lighting apparatus according to an embodiment of the present invention. As shown in FIG. 5, in the case where switching elements (Q1, Q3) of an inverter (Ui) are in an ON state and switching elements (Q2, Q4) are in an OFF state, when the voltage impression drive switching element (Kh) is driven, if the primary and secondary winding directions of the transformer (Th) are set up so that voltage generated in the secondary side winding (Sh) may be additively superposed on output voltage of the inverter (Ui), electric power can be supplied to the discharge lamp (Ld) in a glow discharge state by current, which flows through a path shown in dashed line arrows in FIG. 5. If such a function of the present invention is used, voltage, which the power supply circuit (Ux) outputs to impress no-load open circuit voltage to the lamp, can be made low, so that the maximum output voltage of the power supply circuit (Ux) can be suppressed as low as arc discharge voltage in a steady lighting state.

In such a way, since the voltage that is inputted into the inverter (Ui) provided in the latter part of the power supply circuit (Ux), and voltage, which is outputted therefrom, is suppressed to a low level, switching elements with low voltage resistance can be used as the switching elements (Q1, Q2, Q3, Q4). Since the price of the switching elements (Q1, Q2, Q3, and Q4) with low voltage resistance, an ON resistance thereof, and a loss in a steady lighting state are respectively lower than those of the switching elements with high voltage resistance, a heat radiation countermeasure can be simplified, and total high efficiency, reduction in size and weight, and cost reduction can be realized.

Figure 6:
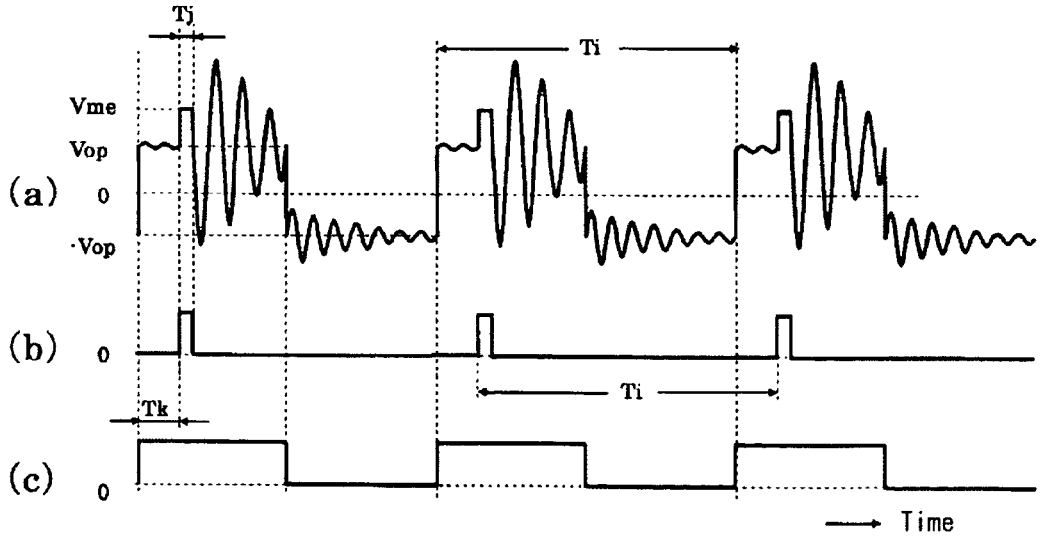
FIG. 6 is a simplified timing diagram of a discharge lamp lighting apparatus according to an embodiment of the present invention.

FIG. 6 is a schematic timing diagram of an example of a discharge lamp lighting apparatus according to an embodiment of the present invention. FIG. 6 shows an example in the case where high voltage is generated in a discharge lamp lighting apparatus shown in FIG. 1. Specifically, (a) shows output voltage of the discharge lamp lighting apparatus (voltage between nodes (T41, T42)), (b) shows a state of an intermittent drive control signal (Sl), and (c) shows a state of an inverter driving signal (Sj), wherein it can be seen that high voltage occurs every cycle (Ti) of the inverter driving signal (Sj).

The inverter (Ui) is driven at predetermined start-up initial frequency (fini) according to the inverter driving signal (Sj). The intermittent drive control signal (Sl) is activated only for a predetermined period (Tj) with a delay of a period (Tk) from an initial phase of the inverter driving signal (Sj). The period (Tk) is set up to eliminate influence due to unstable factors, such as the dead time provided in the inverter control signal (Sf1, Sf2) and polarity-reversal lag time due to the inductance of the transformer (Th).

In the period (Tj), during which the intermittent drive control signal (Sl) is activated, although voltage is impressed to the primary side winding (Ph) of the transformer (Th), since the transformer (Th) is in a no-load state before a breakdown occurs in the discharge lamp (Ld), excitation energy is stored in the transformer (Th). In that case, voltage applied to the discharge lamp (Ld) turns into voltage (Vme), which is generated by superimposing voltage of the secondary side winding (Sh) (generated depending on the turns ratio of the transformer (Th)), on no-load open circuit voltage (Vop), which is outputted by the power supply circuit (Ux) to impress the no-load open circuit voltage to the lamp. When the intermittent drive control signal (Sl) is deactivated, the excitation energy stored in the transformer (Th) is released, and high voltage, which gradually attenuates while oscillating at free-oscillation frequency, is generated in the secondary side winding (Sh). Since the generated voltage becomes higher as the period (Tj) is longer, the period (Tj) is set up so that required voltage can be fully secured.

The inverter driving signal (Sj) and the intermittent drive control signal (Sl) are completely synchronized with a cycle (Ti), and high voltage is superimposed thereon in only one side polarity of the no-load open circuit voltage (Vop). In this embodiment, the intermittent drive control signal (Sl) is required to have such a cycle that energy injection required to make transition from glow discharge to arc discharge, can be effectively performed, as mentioned above, even if the voltage, which is outputted by the power supply circuit (Ux), is lower than that of the glow discharge. Moreover, since the current, which flows immediately after shifting to the arc discharge, is determined by the starting initial frequency (fini) depending on the impedance of the inductance of the transformer (Th), the starting initial frequency (fini) is required to have such a value that current value capable of completing cancellation of a state of asymmetrical electric discharge, which is described below, can be sufficiently secured. In this embodiment, it is configured so that these two requirements may be sufficiently satisfied in the same cycle (Ti).

Figure 7:
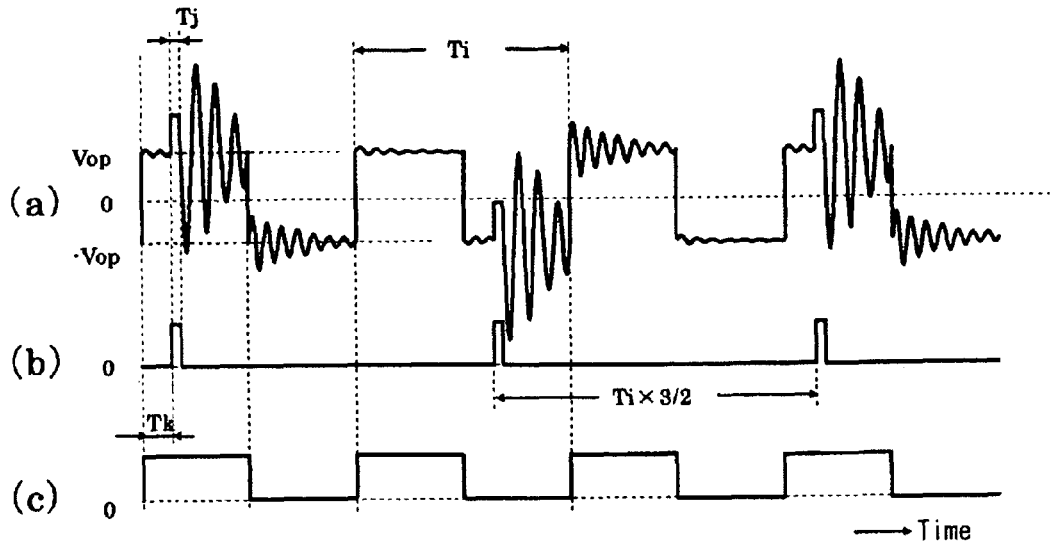
FIG. 7 is a simplified timing diagram of a discharge lamp lighting apparatus according to an embodiment of the present invention.

FIG. 7 is a schematic timing diagram of an example of a discharge lamp lighting apparatus according to an embodiment of the present invention. FIG. 7 shows an example in the case where high voltage is generated in a discharge lamp lighting apparatus shown in FIG. 1. Specifically, in the figure, (a) shows output voltage of the discharge lamp lighting apparatus (voltage between nodes (T41, T42)), (b) shows a state of an intermittent drive control signal (Sl), and (c) shows a state of an inverter driving signal (Sj).

In this example, the inverter driving signal (Sj) is synchronized with 3/2 cycle (Ti) of the intermittent drive control signal (Sl), so that high voltage is superimposed thereon in both polarities of the no-load open circuit voltage (Vop) for every 1.5 cycles of an inverter operation.

Figure 8:
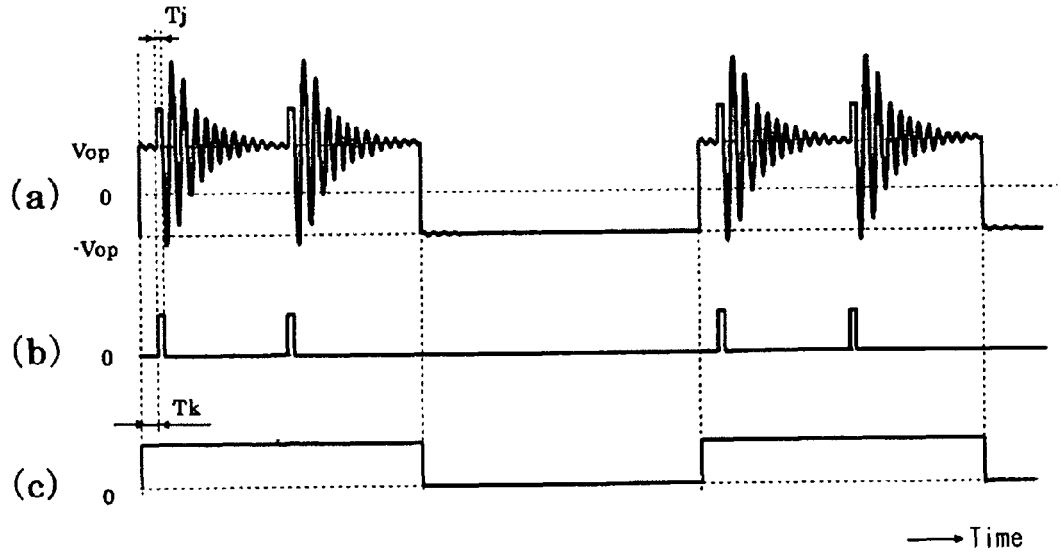
FIG. 8 is a schematic timing diagram of a discharge lamp lighting apparatus according to an embodiment of the present invention.

FIG. 8 is a schematic timing diagram of an example of a discharge lamp lighting apparatus according to an embodiment of the present invention. FIG. 8 shows an example in the case where high voltage is generated in a discharge lamp lighting apparatus shown in FIG. 1. Specifically, (a) shows output voltage of the discharge lamp lighting apparatus (voltage between nodes (T41, T42)), (b) shows a state of an intermittent drive control signal (Sl), and (c) shows a state of an inverter driving signal (Sj).

In this embodiment, high voltage is superimposed thereon twice during a half cycle in one side polarity of an inverter operation. Similar to FIGS. 6, 7, and 8, the relation of a phase and frequency in the case where the inverter driving signal (Sj) is synchronized with the intermittent drive control signal (Sl), may be set up arbitrarily based on circuit design to be realized, such as a current value, which is set through operation frequency of the inverter (Ui) and which is passed immediately after transition to the arc discharge, and frequency and polarity of high voltage to be superimposed. Moreover, the circuit may be affected due to surge voltage or surge current, which may be generated not only in a case where the intermittent drive control signal (S1) is synchronized with the inverter driving signal (Sj) as described above, but also, for example, in a case where polarity-reversal timing of the inverter (Ui) and operation timing of the intermittent voltage applying means (Uk) are matched up with each other. If it is possible to check whether or not such influence is within an acceptable range, the inverter driving signal (Sj) may be made asynchronous with the intermittent drive control signal (Sl).

Figure 9:
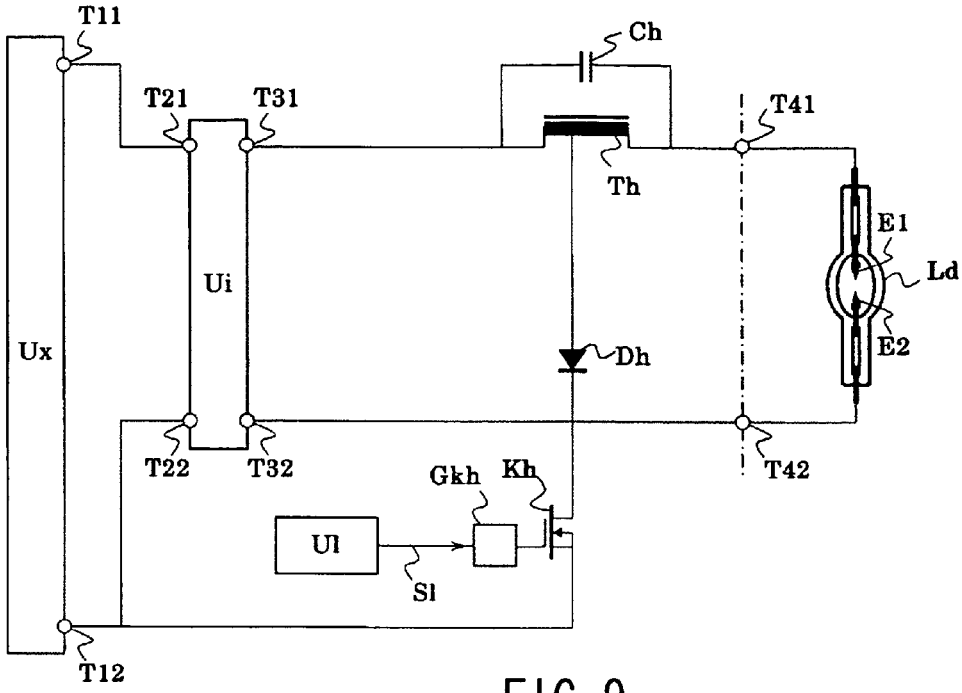
FIG. 9 is a schematic block diagram of a discharge lamp lighting apparatus according to an embodiment of the present invention.

FIG. 9 is a schematic block diagram of an example of a discharge lamp lighting apparatus according to an embodiment of the present invention. In the transformer (Th) of the discharge lamp lighting apparatus shown in FIG. 9, a primary side winding (Ph) and a secondary side winding (Sh) are configured in common, to form a intermediate tap structure. In such a configuration, when a required insulting characteristic between the primary and the secondary of the transformers (Th) is lowered, it is possible to, for example, simplify a barrier structure of winding, or reduce the total number of turns of the primary and secondary windings, whereby it is advantageous in reduction in size and weight, and cost reduction. Moreover, although the embodiments are mainly described above such that the capacitor (Ch) is connected in parallel with the secondary side winding (Sh), the capacitor (Ch) is connected in parallel with the entire transformer (Th) in the discharge lamp lighting apparatus shown in FIG. 9.

Supplement to the transformer (Th) will be given below. Although in the description given above, the transformer (Th) having only one secondary side winding (Sh) is connected to one of the electrodes (E1, E2) for the main discharge of the discharge lamp (Ld), the transformer (Th) may have two secondary side windings, each of which may be connected to each electrode (E1, E2), so that voltage with opposite polarities may be impressed thereto respectively. In such a case, when the capacitor (Ch) is connected to the secondary side winding, it may be connected to one of the two secondary side windings, or may connected to both of them. The structure of the discharge lamp lighting apparatus shown in FIG. 9 have an advantage that an inductance value of the transformer (Th) may be made small. For example, it is possible to set the value to 160 μH or less so that it is possible to solve disadvantageous phenomena, such as an overshoot of light flux at time of polarity reversals and vibration.

Figure 10:
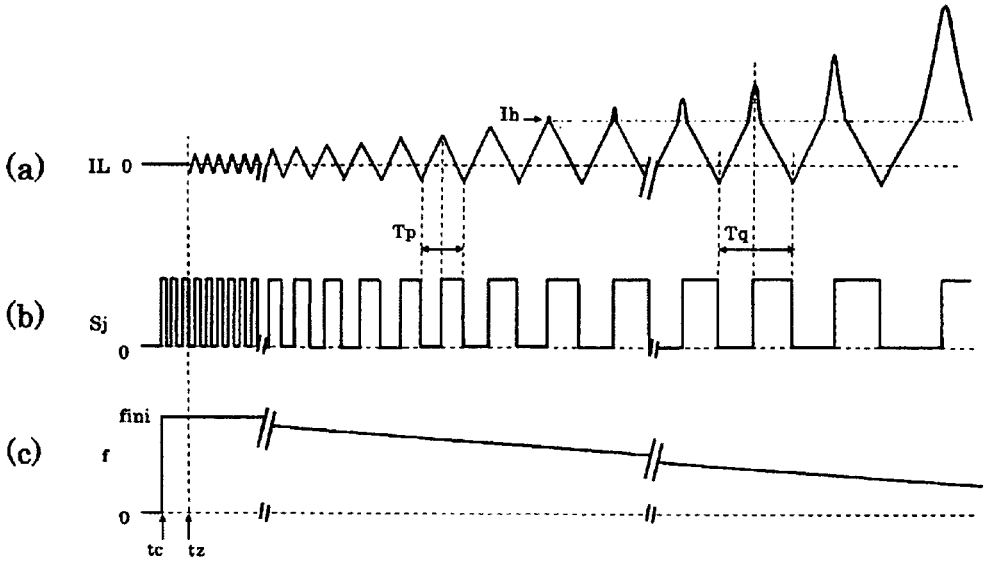
FIG. 10 is a schematic block diagram of a discharge lamp lighting apparatus according to an embodiment of the present invention.

Further description will be given below referring to FIG. 10. FIG. 10 is a schematic timing diagram of a discharge lamp lighting apparatus according to an embodiment of the present invention. Specifically, FIG. 10 shows an example of waveforms, which may be observed in an adjustment stage of a starting sequence, in which the discharge lamp lighting apparatus shown in FIGS. 1, 5, and 9, etc. is operated at a starting initial frequency (fini) so that a discharge lamp (Ld) is started. In the figure, (a) shows a waveform of lamp current (IL), which flows through the discharge lamp (Ld), (b) shows a waveform of an inverter driving signal (Sj), and (c) shows a changing state of frequency (f) of the inverter (Ui).

By repeating a voltage impression drive performed by the intermittent voltage applying unit (Uk), oscillating high voltage, which is outputted from the secondary side winding (Sh), is superposed thereon, so that an electric breakdown occurs in the discharge lamp (Ld) at time (tz), whereby current starts to flow through the discharge lamp (Ld). After the breakdown, although asymmetrical electric discharge phenomenon, in which current flows in only one side direction of the discharge lamp electrode, and glow discharge occur. However, during a period in which the glow discharge occurs, voltage between both electrodes of the lamp becomes voltage specific to a discharge state of the lamp, just like a zener diode. In addition, in a period of the glow discharge, high voltage is not generated in the secondary side winding (Sh) due to a flyback action of the transformer (Th), since the impedance of the lamp is small.

FIG. 10 shows a state where asymmetrical electric discharge occurs in the discharge lamp (Ld). Specifically, in the figure, (a) shows an example in which much lamp current (IL) flows in a positive side direction, and less current flows in a negative side direction. Such a waveform tends to be observed, when arc discharge occurs in the positive side direction of the lamp current (IL) and glow discharge occurs in the negative direction. In a glow discharge period, since lamp voltage is high even though lamp current is small, cations, which are accelerated in the electrical discharge space of the lamp by high energy, collide with the cathode electrode. Therefore, if the glow discharge continues for a long time, electrode material, such as tungsten, is sputtered into the electrical discharge space by sputtering to adhere on the inner surface of the lamp bulb, whereby there is a problem that blackening of the lamp occurs. Therefore, in the period of such asymmetrical electric discharge, there is an advantageous in making quick shift from glow discharge to arc discharge by accelerating heating of electrode by passing much current therethrough.

It is necessary to maintain an output of the power supply circuit (Ux) to be in a control state capable of outputting the above-described no-load open circuit voltage (Vop), that is, voltage of typically approximately 200 V, at a starting sequence of the lamp. This is because the glow discharge of the lamp needs to be maintainable. As mentioned above, if the glow discharge continues for a long time, there is a problem that the blackening of the lamp occurs. However, if the glow discharge cannot be even maintained, discharge current stops flowing so that the discharge may go out. Another reason therefor is that when the drive frequency of the inverter (Ui) is, for example, 100 kHz, the impedance of the secondary side winding (Sh) of the transformer (Th) also becomes high due to such high frequency, so that to make shift to arc discharge and to maintain it, approximately the above mentioned voltage is required as voltage impressed to the series connection of the discharge lamp (Ld) and the secondary side winding (Sh).

As described above, it is advantageous to make quick shift from glow discharge to arc discharge. As a method of make such quick shift, it can be considered that, for example, no-load open circuit voltage is made higher, and the applied power to the lamp is increased at the time of glow discharge. However, to realize such a method, elements having high voltage resistance, which correspond to high no-load open circuit voltage, are required for the switching element (Q1, Q2, Q3, Q4) of the inverter (Ui), so that there is disadvantage in cost reduction.

Therefore, it turns out that, in the period of asymmetrical electric discharge, it is necessary to decrease high impedance of the secondary side winding (Sh) of the transformer (Th), as a remaining method for passing much lamp current therethrough to accelerate heating of the electrode, thereby making quick shift from glow discharge to arc discharge. In the first place, after the starting sequence of the lamp is completed, the drive frequency of the inverter (Ui) is eventually shifted to low frequency, for example, approximately 50 Hz-400 Hz, which is frequency at time of stable lighting of the discharge lamp (Ld). Therefore, when the shift to such low frequency is completed, it may be considered that the problem in which the impedance of the above mentioned secondary side winding (Sh) is high, may be naturally solved.

However, when the drive frequency of the inverter (Ui) is suddenly changed from the high frequency at start-up time, for example, approximately 100 kHz into the above mentioned low frequency, excessive rush current may sometimes flow through the discharge lamp (Ld). This is because control of the power supply circuit (Ux) cannot be followed so that the current, which flows through the discharge lamp (Ld), increases momentarily in a positive feedback manner, since the impedance of the secondary side winding (Sh) of the transformer (Th) rapidly decreases with rapid decrease of the frequency of the inverter (Ui), and since the impedance of the discharge lamp (Ld) itself decreases as a result of rush current flowing through the discharge lamp (Ld). Therefore, there is a problem of possible damage to the discharge lamp (Ld), the switching element (Q1, Q2, Q3, Q4) of the inverter (Ui) or the switching element (Qx) of the power supply circuit (Ux), etc.

Moreover, in a state of the asymmetrical electric discharge in the discharge lamp (Ld), unless heating is facilitated to start thermionic emission to an electrode, which does not cause arc discharge in a cycle in which the electrode serves as a cathode, and which is one of the electrodes (E1, E2), a state of the asymmetrical electric discharge cannot be cancelled. In such a state, although a half cycle in which large power is applied to the lamp and a half cycle in which small power is applied to the lamp which are in one cycle of an alternating current drive of the inverter (Ui), is repeated, the electrode, which cannot start thermionic emission in a period of the half cycle with small power applied to the lamp, drops in temperature. While a state of asymmetrical electric discharge is not cancelled, if the drive frequency of the inverter (Ui) is suddenly shifted to low frequency, a period of each half cycle suddenly becomes long. Therefore, since the temperature of the electrode, which cannot start thermionic emission, excessively drops in temperature in the period of the half cycle with small power applied to the lamp, which becomes long, there is a high possibility that the discharge lamp (Ld) goes out since electric discharge cannot be maintained.

When referring back to the above mentioned description, in a starting sequence of the lamp, when the drive frequency of the inverter (Ui) is shifted to low frequency at time of stable lighting of the final discharge lamp (Ld), it turns out that it is necessary to make a shift to the final low frequency without rapidly shifting thereto after performing a step of gradually reducing the frequency from starting initial frequency (fini).

FIG. 10 shows a state where the inverter (Ui) is operated so that a cycle in which a polarity reversal occurs, is gradually made long after the discharge lamp (Ld) reaches an electric breakdown at time (tz) so that current starts to flow through the discharge lamp (Ld). The waveform (a) of the lamp current (IL) is formed of sawtooth-like waveform, which is synchronized so that the inverter driving signal (Sj) of (b) is integrated with. A brief description of the waveform in a typical period (Tp) will be given below.

In (a) of the figure, the positive side of the lamp current (IL) (an upper side in this diagram) corresponds to a direction in which arc discharge occurs. For example, when the input voltage of the inverter (Ui), that is, the output voltage of the power supply circuit (Ux) is 200 V and the arc discharge voltage of the discharge lamp (Ld) is 20V, the lamp current (IL) increases at speed that is calculated by dividing voltage, which is applied to the secondary side winding (Sh) of the transformer (Th), that is, voltage difference of 200 V and 20 V, by the inductance value of the secondary side winding (Sh). Since the arc discharge voltage is small enough as compared with the output voltage of the power supply circuit (Ux), in general, a peak value of the sawtooth-like waveform in the lamp current (IL) is proportional to the output voltage of the power supply circuit (Ux), and proportional to time of a half cycle of the inverter (Ui). Therefore, if the output voltage of the power supply circuit (Ux) increases, a maximum value of the lamp current (IL) also increases, and if a cycle of the inverter (Ui) increases, a maximum value of the lamp current (IL) also increases.

In a half cycle during which current flows in a positive side direction, the inverter (Ui) shown in the figure is increased, while magnetic energy is accumulated in the secondary side winding (Sh), so that the current flows from the inverter (Ui) to the discharge lamp through the secondary side winding (Sh), and if the polarity of the inverter (Ui) is reversed, the lamp current (IL) is decreased while the magnetic energy accumulated in the secondary side winding (Sh) is released, wherein such operations are repeated by turns. Thus, since the maximum current value of the lamp current (IL) can be gradually increased by continuously reducing the drive frequency of the inverter (Ui) to low frequency, it is possible to obtain advantages that heating is facilitated to be able to start thermionic emission to an electrode, which does not cause arc discharge in a cycle in which the electrode serves as a cathode, so that a state of asymmetrical electric discharge can be canceled, whereby it is possible to prevent the discharge from going out.

However, in a period (Tq) in FIG. 10, the waveform of the lamp current (IL) is different from an ideal sawtooth-like waveform in a period (Tp), in which excessive current flows near a peak thereof, and in that period, the excessive current becomes larger, as the drive frequency of the inverter (Ui) becomes lower. This is because the lamp current (IL) exceeds the saturation limit current value (Ih) of the secondary side winding (Sh) of the transformer (Th), and a period, during which it exceeds the saturation limit current value (Ih) becomes longer, as the drive frequency of the inverter (Ui) becomes lower.

Figure 11:
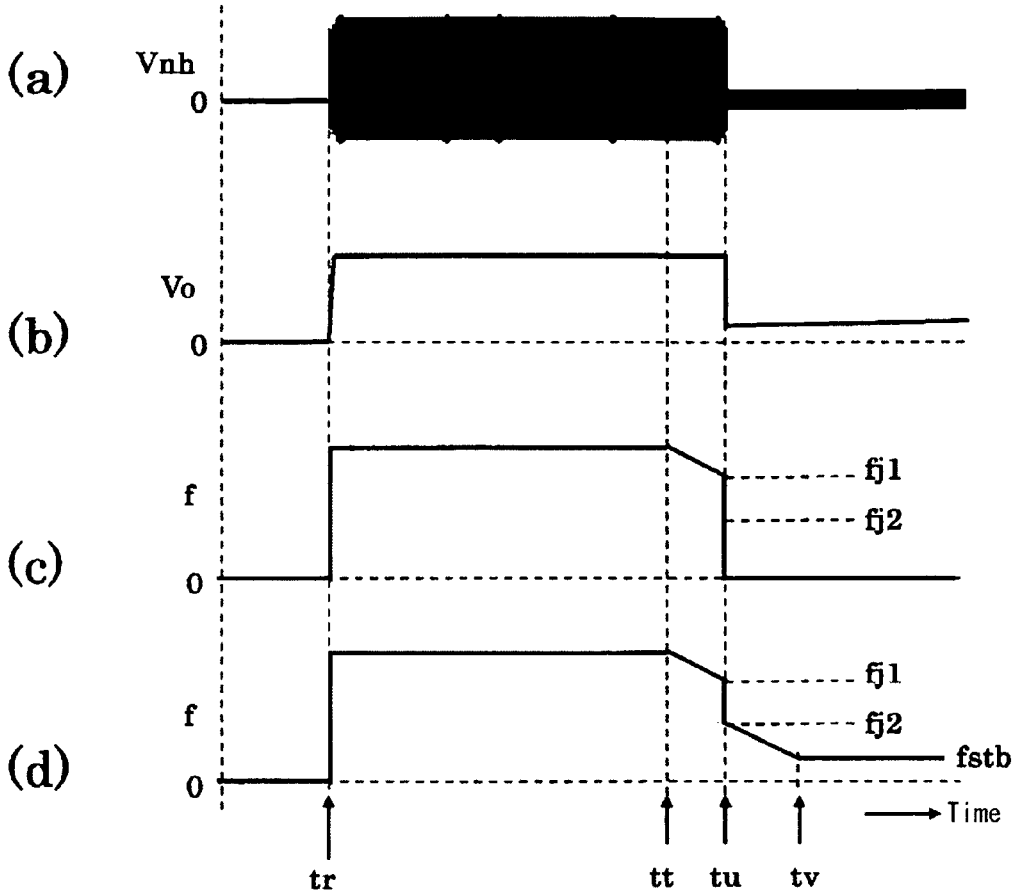
FIG. 11 is a schematic block diagram of a discharge lamp lighting apparatus according to an embodiment of the present invention.
Figure 16:
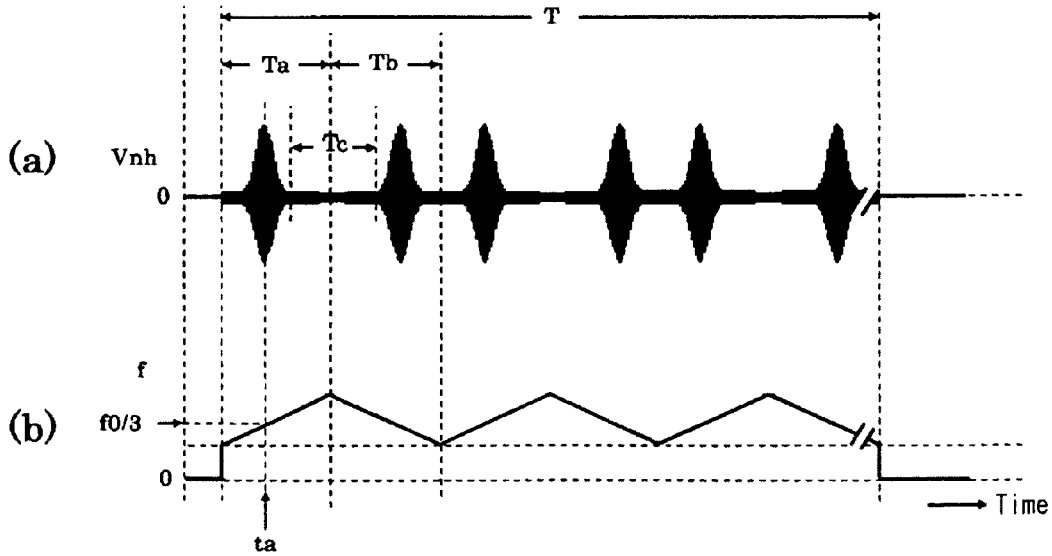
FIG. 16 Prior Art
FIG. 16 is a schematic timing diagram of a conventional discharge lamp lighting apparatus.
Figure 17:
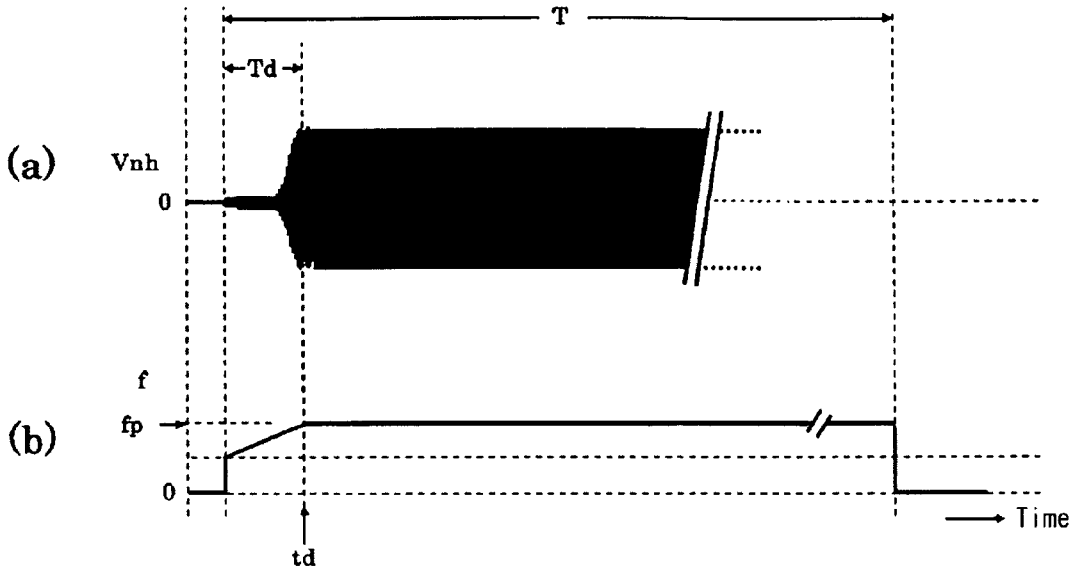
FIG. 17 Prior Art
FIG. 17 is a schematic timing diagram of a conventional discharge lamp lighting apparatus.

Further description will be given referring to FIG. 11. FIG. 11 shows a schematic timing diagram of an example of a discharge lamp lighting apparatus according to an embodiment the present invention. In FIG. 11, (a) shows a waveform of output voltage of a discharge lamp lighting apparatus (voltage between nodes (T41, T42)), (b) shows a waveform of output voltage (Vo) of a power supply circuit (Ux), (c) shows a changing situation of frequency (f) of an intermittent voltage applying unit (Uk), and (d) shows a changing situation of frequency (f) of an inverter (Ui). First, the starting sequence of the discharge lamp (Ld) is started at time (tr). Part of waveform (a) of FIG. 11 is colored in black. The figure schematically shows a situation where it is not possible to display oscillating voltage waveform with sufficient resolution so that only the information that is going back and forth between upper and lower peaks is displayed thereon, as can be seen in the case where a high frequency wave in a long time range is observed by an oscilloscope. This situation is the same as those of FIGS. 14, 16 and 17 that are described below.

While frequency of the inverter (Ui) is set to starting initial frequency (fini) that can control an optimal value of current that is passed after electric breakdown, the intermittent voltage applying unit (Uk) starts an intermittent voltage impression drive with respect to the primary side winding (Ph) of the transformer (Th), so that high voltage is promptly generated as output voltage of this discharge lamp lighting apparatus according to the embodiment. And soon, an electrical breakdown arises in the discharge lamp (Ld), whereby the lamp current (IL) begins to flow. As seen in a waveform (b) of FIG. 11, the power supply circuit (Ux) consistently outputs no-load open circuit voltage (Vop) and supplies it to the inverter (Ui) from beginning of a starting sequence. Since the intermittent voltage applying unit (Uk) is continuously operated, if the discharge goes out in the electric discharge (Ld), the high voltage is promptly generated to be superimposed on no-load open circuit voltage (Vop) and impressed to the discharge lamp (Ld), whereby it is possible to continuously realize a state where electric discharge can be restarted immediately.

As described above, since at time (tt), a sequence is started so that the drive frequency of the inverter (Ui) is shifted to the final low frequency, wherein such sequence includes a step in which frequency is gradually reduced from the high frequency at time of start up (that is, the starting initial frequency (fini)), much lamp current flows therethrough so that heating of the electrode is facilitated. Consequently, even if the lamp current (IL) is in a state where the polarity is disproportioned to one side, it gradually shifts to a state where the balance of positive/negative is improved, so that a state of asymmetrical electric discharge is gradually resolved.

And, when the frequency of the inverter (Ui) decreases to a first threshold frequency (fj1) at time (tu), a state (voltage control mode), where control is performed to output no-load open circuit voltage (Vop), is canceled, and for example, while a control mode of the power supply circuit (Ux) is switched to a state (current control mode) where control is performed so that an electric supply current detection signal (S1) turns into a target value, the frequency of the inverter (Ui) is controlled to be rapidly decreased to a second threshold frequency (fj2). Here, the "state (current control mode), in which the control is performed so that the electric supply current detection signal (Si) becomes a target value", means the operation that is described above, in which, when a lamp operation starts and discharge current flows, the feed control circuit (Fx) generates the gate driving signal (Sg) in a feedback manner so that the target lamp current may be outputted therefrom.

By controlling it in this way, since the frequency of the inverter (Ui) becomes sufficiently low, the impedance of the secondary side winding (Sh) of the transformer (Th) is sufficiently low, and since the voltage of the power supply circuit (Ux) becomes almost equal to the lamp voltage of the discharge lamp (Ld), high voltage, such as no-load open circuit voltage becomes unnecessary as output voltage of the power supply circuit (Ux). Of course, since superimposition of the high voltage by the transformer (Th) also becomes unnecessary, the intermittent drive control circuit (Ul) is deactivated, so that the intermittent voltage applying unit (Uk) stops. Thus, in a state where the frequency of the inverter (Ui) is sufficiently low, and in addition, the output voltage of the power supply circuit (Ux) becomes sufficiently low to the extent of the arc discharge voltage of the discharge lamp (Ld), since there is no a quick change or a peak of the lamp current (IL) as in the waveform (a) of FIG. 10, the lamp current (IL) can be correctly controlled by controlling the electric supply current detection signal (Si). As a result, as to the above mentioned lamp current (IL), the lamp current (IL) resulting from excessive saturation limit current value (Ih) of the secondary side winding (Sh) of the transformer (Th) can be prevented from becoming excessive current. The frequency of the intermittent voltage applying unit (Uk) that is shown as a waveform (c) of FIG. 11 is changed to follow change of the frequency of the inverter (Ui) shown as (d) of FIG. 11 up to time (tu). As described above in connection with FIGS. 6, 7, and 8, it is desirable to always maintain specific phase relation that should be established between the intermittent driving control signal (Sl) and the inverter driving signal (Sj), that is, between an operation of the intermittent voltage applying unit (Uk) and an operation of the inverter (Ui), in a process in which the drive frequency of the inverter (Ui) is changed. However, since a period in which there is a possibility that the electric discharge lamp (Ld) goes out, normally ends by a time point (tt), the intermittent drive control circuit (Ul) may be deactivated and the intermittent voltage applying unit (Uk) may be stopped at this time. In this case, for example, the frequency of the intermittent voltage applying unit (Uk), which is shown as (c) of FIG. 11, need not to be controlled to be changed by following the frequency of the inverter (Ui).

In addition, since the frequency of the inverter (Ui) and the above-mentioned control mode of the power supply circuit (Ux) are switched simultaneously at the time point (tu), rush current may flow through the discharge lamp (Ld) at the time point (tu), depending on the variation in delicate switching timing (jitter). Since the length of the period in an ON state of the switching element (Qx) can be restricted by using pulse-by-pulse control technology or since an appearance of the time point (tu) can be controlled by the discharge lamp lighting apparatus itself, a phenomenon in which the rush current flows therethrough can be avoided by a method in which output voltage of the power supply circuit (Ux) or a target value of output current is set up to a low level just before the appearance of the time point (tu), or a method in which the length of the period in a ON state of the switching element (Qx) is restricted.

Exact time until the secondary side winding (Sh) of the transformer (Th) begins to saturate when no-load open circuit voltage is impressed, cannot be simply calculated by speed which is obtained by dividing voltage applied to the secondary side winding (Sh) by an inductance value, since a saturation phenomenon is a nonlinear phenomenon. Therefore, it is desirable that the first threshold frequency (fj1) be experimentally obtained and set up, by taking into consideration, a variation of the saturation limit current value (Ih) of the secondary side winding (Sh). In FIG. 11, the frequency of the inverter (Ui) is controlled to be rapidly decreased to the second threshold frequency (fj2), at the time point (tu) when the frequency of the inverter (Ui) decreases to the first threshold frequency (fj1). However, since it takes time for the thermal balance of the electrode (E1, E2) of the lamp to be accomplished, to cancel a state of asymmetrical electric discharge, the certainty of a state cancellation of the asymmetrical electric discharge can be increased by performing control to stand by for only suitable time, in a state of the first threshold frequency (fj1) before the frequency of the inverter (Ui) is controlled to be decreased to the second threshold frequency (fj2).

In addition, the reason why the frequency of the inverter (Ui) is not directly shifted from the first threshold frequency (fj1) to the stable lighting frequency (fstb) but is gradually shifted to the stable lighting frequency (fstb) after shifting to the second threshold frequency (fj2), is to complete cancellation of a state of asymmetrical electric discharge before the shift to the stable lighting frequency (fstb) is completed after the frequency is shifted to the second threshold frequency (fj2), in a case where the cancellation of the state of asymmetrical electric discharge has not been completed when the frequency of the inverter (Ui) is rapidly decreased from the first threshold frequency (fj1).

Figure 12:
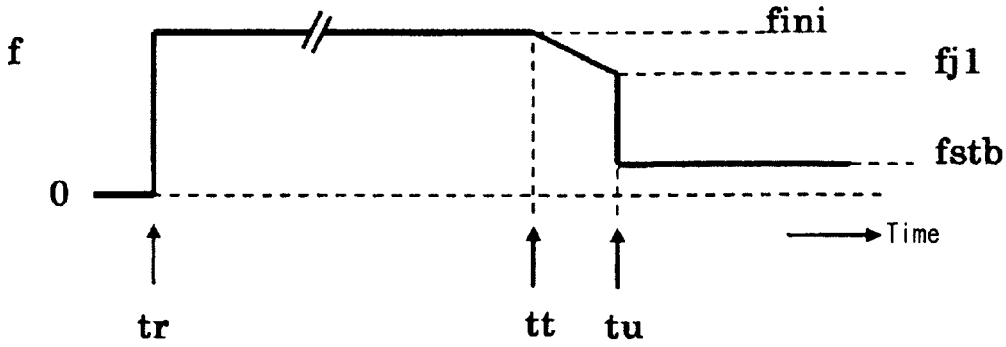
FIG. 12 is a schematic block diagram of a discharge lamp lighting apparatus according to an embodiment of the present invention.

It is described above that control is performed to wait for an appropriate period in a state of the first threshold frequency (fj1) before the frequency of the inverter (Ui) is decreased to the second threshold frequency (fj2). However, whether or not such an operation is carried out, if the cancellation of the state of asymmetrical electric discharge is completed when the frequency of the inverter (Ui) is rapidly decreased from the first threshold frequency (fj1), for example, in the case where the heat capacity may be small to easily accomplish the thermal balancing of the electrode (E1, E2) of the lamp, that is, to easily raise the temperature thereof, the frequency of the inverter (Ui) may be controlled to make a direct shift from the first threshold frequency (fj1) to the stable lighting frequency (fstb). A situation of control of the frequency of the inverter (Ui) at this time will be given below, referring to FIG. 12. FIG. 12 is a schematic timing diagram of an example of a discharge lamp lighting apparatus according to an embodiment of the present invention.

As described above, a rise in temperature of the electrode (E1, E2) by electric discharge heating in a discharge lamp (Ld) is important, and it depends on electric power applied to the lamp and the heat capacity of the electrode(s). As is apparent from the above description, the electric power applied to the lamp is determined not only by the impedance of the secondary side winding (Sh) of the transformer (Th) for which the frequency of the inverter (Ui) is a parameter, but also by the output voltage of the power supply circuit (Ux). Therefore, since an optimum value of the length of the transition period from a time point (tt) to a time point (tu) depends on the output voltage of the power supply circuit (Ux) or the heat capacity of the electrode (E1, E2) in this transition period, it is necessary to obtain the optimal value. It is necessary to experimentally obtain the optimum value of the length of the transition period from the time point (tu) to the time point (tv), including a case where the length of transition period is zero. In addition, although the decreasing speed of the frequency at the time of shift from the second threshold frequency (fj2) to the low frequency of the final stable lighted state, i.e., the stable lighting frequency (fstb) is shown in FIG. 11 in a similar manner to that of the decreasing speed of the frequency from the time point (tt), such decreasing speed may be different from each other.

The simplest way of setting the time point (tt), which is a starting point of a sequence for gradually decreasing the drive frequency of the inverter (Ui) from the high frequency at time of start up, is to set, as the time point (tt), for example, a time point in which a predetermined length of time elapses from a time point (tr), which is a starting point of the sequence. Or it is possible to set, as the time point (tt), a time point at which an electrical breakdown arises in the discharge lamp (Ld), and a predetermined length of time elapses from a time point (ts) at which the lamp current (IL) begins to flow. Furthermore, it is also possible set, as the time point (tt), a time point at which the lamp current (IL) begins to flow and a predetermined length of time (zero is included) elapses from a time point (tw) at which the current value increases to a value corresponding to arc discharge. In addition, it is possible to detected, by supervising the feed current detection signal (Si) from the feed current detection unit (Ix), that the discharge lamp (Ld) begins to flow or the current value increases to the value equivalent to arc discharge.

When the drive frequency of the inverter (Ui) becomes low exceeding a limit, a phenomenon, in which the lamp current (IL) exceeds the saturation limit current value (Ih) of the secondary side winding (Sh) of the transformer (Th) as described above, occurs. The amplitude of the saturation limiting current value (Ih) depends on physical properties, shape, and volume of core material that forms the secondary side winding (Sh). Therefore, for example, if there is a value that should be set up as the first threshold frequency (fj1) to realize a good lamp life span, there is a problem in which reduction in cost, size and weight of the discharge lamp lighting apparatus is restricted, since core material that can realize the value must be selected.

To avoid this problem, along with an operation of the periodic drive circuit (Uj), which generates the inverter drive signal (Sj) to gradually decrease the frequency of the inverter (Ui) until the frequency of the inverter (Ui) reaches the first threshold frequency (fj1) from the start-up initial frequency (fini), the electric supply control circuit (Fx) controls the power supply circuit (Ux) to output voltage, which gradually decreases until the voltage reaches predetermined voltage (Vo2) which is lower than the no-load opening voltage (Vop). As described above, although the peak value of the current of the secondary side winding (Sh) of the transformer (Th) is proportional to time of the half cycle of the inverter (Ui), it is also proportional to the output voltage of the power supply circuit (Ux). Although time of the former half cycle increases with passage of time by controlling in this way, since the output voltage of the latter power supply circuit is controlled to decrease, the speed of the increase in the peak value of the current of the secondary side winding (Sh) of the transformer (Th) becomes lower than the case where the output voltage of a power supply circuit is fixed.

Figure 13:
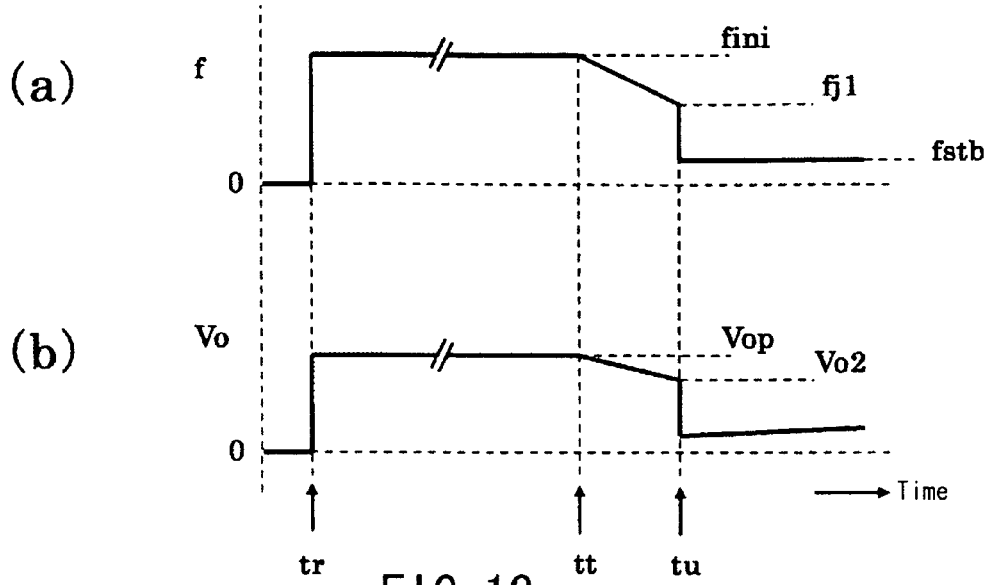
FIG. 13 is a schematic block diagram of a discharge lamp lighting apparatus according to an embodiment of the present invention.

This situation will be described below, referring to FIG. 13. FIG. 13 is a schematic timing diagram of an example of a discharge lamp lighting apparatus according to an embodiment of the present invention. In FIG. 13, (a) shows a situation of change of a drive frequency of the inverter (Ui), and (b) shows a waveform of a power supply circuit output voltage (Vo). Thus, when the output voltage of a power supply circuit (Ux) and the drive frequency of the inverter (Ui) are controlled, while conditions at a staring time point of a sequence, in which the drive frequency of the inverter (Ui) is gradually reduced from high frequency at time of start up from the time point (tt), that is, no-load open circuit voltage (Vop) and frequency of the inverter (Ui), are exactly the same as the case that is explained above in connection with FIG. 11, it is possible to set up first threshold frequency (fj1), which is much lower than that, without producing the phenomenon in which it exceeds the saturation limit current value (Ih).

Although FIG. 13 shows a case where timing of starting to decrease the frequency of the inverter (Ui) and that of starting to decrease the output voltage of the power supply circuit (Ux) are simultaneous, for example, control may be performed to delay the timing of starting to decrease the output voltage of the power supply circuit (Ux). Moreover, control may be performed to stop decreasing the output voltage of the power supply circuit (Ux) while the frequency of the inverter (Ui) is decreased.

Figure 14:
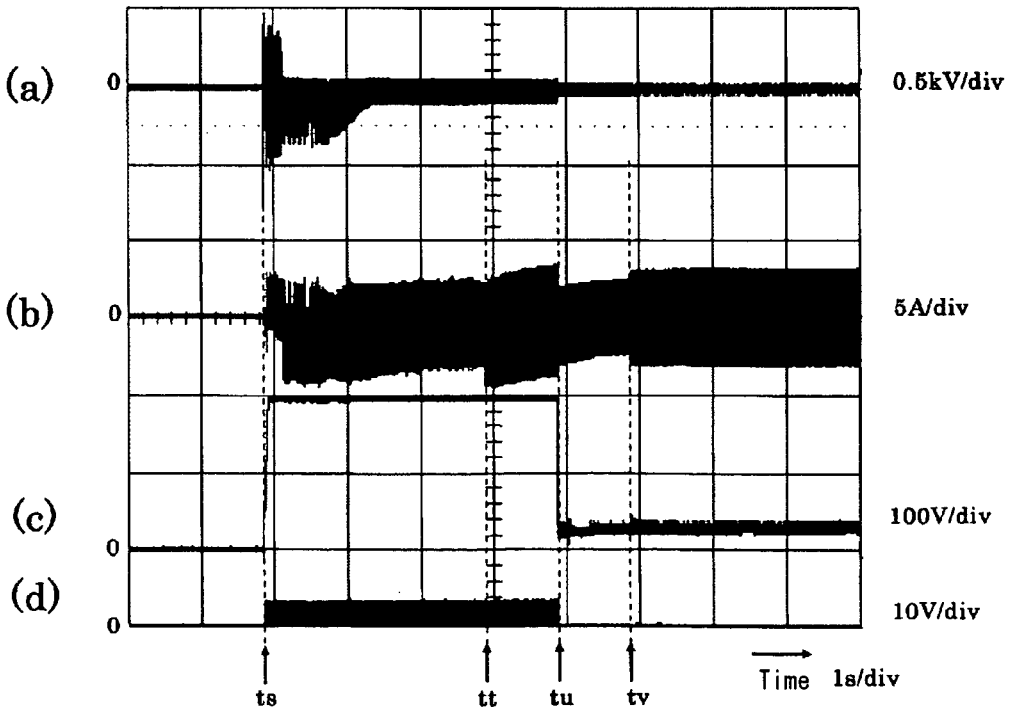
FIG. 14 is a schematic block diagram of a discharge lamp lighting apparatus according to an embodiment of the present invention.
Figure 15:
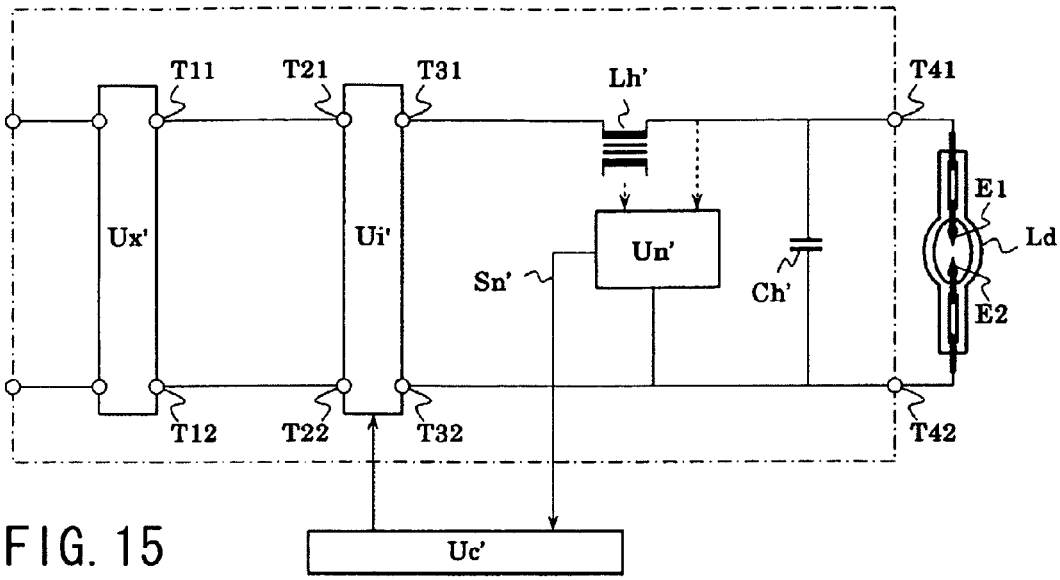
FIG. 15 Prior Art
FIG. 15 is a schematic view of a conventional discharge lamp lighting apparatus.

FIG. 14 is a schematic timing diagram of an example of a discharge lamp lighting apparatus shown in FIG. 11 according to an embodiment of the present invention, wherein actually measured waveforms are shown. In the figure, (a) shows output voltage of a discharge lamp lighting apparatus (voltage between nodes (T41, T42)), (b) shows a waveform of lamp current (IL), (c) shows a waveform of power supply circuit output voltage (Vo), (d) shows a situation of an intermittent driving control signal (Sl), respectively.

Concrete numerical parameters of the discharge lamp lighting apparatus according to the embodiment of the present invention, whose waveform was actually measured and is shown in FIG. 14, are set forth below. Rated power of a high pressure mercury lamp is 200 W. No-load opening voltage (Vop) is 200 V. Start-up initial frequency (fini) is approximately 80 kHz. First threshold frequency (fj1) is 50 kHz. Second threshold frequency (fj2) is 5 kHz. Stable lighting frequency (fstb) is 370 Hz. A waiting period to start a sequence in which frequency is gradually reduced from beginning of a starting sequence (from a time point (tr) to a time point (tt)) is approximately 3 seconds. In addition, a transition period from start-up initial frequency to a first threshold frequency (from a time point (tt) to a time point (tu)) is approximately 1 second. A transition period from second threshold frequency to stable lighting frequency (a time point (tu) to a time point (tv)) is approximately 1 second. In addition, in the discharge lamp used for this actual measurement experiment, conditions of from 0.2 seconds to 3 seconds as a transition period from the start-up initial frequency to the first threshold frequency, were tried, and good results were obtained in this range.

The parameters etc. relating to the embodiment of the present invention, which are described in relation to the FIG. 14, can be applied to a high pressure mercury lamp, in which a pair of electrodes facing each other at an interval of 2.0 mm or less, each having a projection formed at a tip thereof, and mercury of 0.2 $mg/mm^3$ or more and $1\times10^{-6}$ $\mu mol/mm^3$ to $1\times10^{-2}$ $\mu mol/mm^3$ of halogen are enclosed. Although dielectric breakdown arise in the discharge lamp (Ld) at a time point (ts), so that the lamp current (IL) begins to flow therethrough, it turns out that a state of asymmetrical electric discharge arises, wherein a waveform of the lamp current (IL) is disproportioned to the negative side for a while after the time point (ts).

At a time point (tt), as described above, much lamp current flows and heating of the electrodes is accelerate by starting the sequence in which the drive frequency of the inverter (Ui) is shifted to a final low frequency, wherein the sequence includes a step of gradually reducing from the high frequency at start-up time. Therefore, as understood from a state where the lamp current (IL) is gradually shifted from a state where it is disproportioned to the negative side, to a state where the balance of positive/negative is improved, the state of asymmetrical electric discharge is gradually resolved.

As seen from the waveform shown in FIG. 14, which was actually measured, as explained in connection with FIG. 11, at a time point (tt), much lamp current flows and heating of the electrodes is accelerated, thereby making a gradual shift to a state where the balance of positive/negative is improved, from a state where it is disportioned to the positive side in a waveform of the lamp current (IL), by starting the sequence in which the drive frequency of the inverter (Ui) is shifted to the final low frequency, wherein the sequence includes a step of gradually reducing the frequency from the high frequency at start-up time. Thus, it is possible to confirm advantages of the present invention, that resolution of a state of asymmetrical electric discharge is accelerated.

As described above, according to the embodiments of the present invention, by repeating the voltage impression drive to the primary side winding (Ph) of the transformer (Th) performed by the intermittent voltage impression unit (Uk), the state, in which in the electrodes (E1, E2) for main discharge of the discharge lamp (Ld), oscillating high voltage, which is outputted from the secondary side winding (Sh), is superimposed on the voltage, which is outputted from the power supply circuit (Ux), is realized almost in a continuous fashion, so that dielectric breakdown arises in the electrical discharge space of the discharge lamp (Ld), whereby it is possible to start main discharge of the lamp. In the period of the glow discharge in the discharge lamp (Ld), energy injection to the lamp in a glow discharge state, can effectively performed by the repetition of the voltage impression drive to the primary side winding (Ph), which is performed by the intermittent voltage impression unit (Uk), whereby it is possible to give, to the discharge lamp (Ld), energy which is required and sufficient for making shift to arc electric discharge.

When the drive frequency of the inverter (Ui) is shifted to the final low frequency at time of stable lighting of the discharge lamp (Ld) from the high frequency at start-up time, since a maximum current value of the lamp current (IL) can be gradually increased by continuously decreasing toward the low frequency rather than rapidly making shift thereto, it is possible to obtain advantages that heating is facilitated to be able to start thermionic emission to an electrode, which does not cause arc discharge in a cycle in which the electrode serves as a cathode, so that a state of asymmetrical electric discharge can be canceled, whereby it is possible to prevent the discharge from going out.

In this case, the previous state (voltage control mode), in which control is performed to output no-load opening voltage, is terminated, at a time point when the frequency of the inverter (Ui) is decreased to the first threshold frequency (fj1), so that the lamp current (IL) may not exceed the saturation limit current value (Ih) of the secondary side winding (Sh) of the transformer (Th), and, for example, while the control mode of the power supply circuit (Ux) is changed to switch therefrom to a state (current control mode) in which control is performed so that the electric supply current detection signal (Si) may become a target value, control is performed so that the frequency of the inverter (Ui) is rapidly reduced to the second threshold frequency (fj2), which is low enough for the power supply circuit (Ux) to be able to correctly control the lamp current (IL), whereby it is possible to prevent excessive peak current, which flows therethrough, from damaging the discharge lamp (Ld), the power supply circuit (Ux), and the switching element (Qx, Q1, Q2, Q3, Q4) of the inverter (Ui).

A circuit configuration given in the specification is described at minimum to explain the operations, functions and actions of the discharge lamp lighting apparatus according to the present invention. Therefore, it is premised that determination of the details of the circuit configuration or the actions described above, for example, determinations of the polarity of signals, or originality and creativity, such as selections, additions, or omissions of concrete circuit elements, convenience of procurements of elements, or changes based on economic reasons, are carried out at the time of the design of actual apparatus.

In the actual structure of a discharge lamp lighting apparatus, it is not necessarily to separately independently provide respective functional blocks, such as the electric supply control circuit (Fx), the intermittent drive controlling circuit drive control circuit (Ul), the periodic driving circuit (Uj) and/or the inverter drive circuit (Uc), and, for example, some of these functional blocks may be realized by software-based functions in a microprocessor or a digital signal processor.

It is premised that mechanism for protecting circuit elements, such as switching elements (for example, an FET etc.) from breakage factors, such as an overvoltage, and overcurrent, or overheating, or mechanism for reducing a radiation noise or a conduction noise, generated with an operation of the circuit element of the power supply apparatus or preventing the generated noise from releasing to the outside, for example, a snubber circuit, and a varistor, a clamp diode, a current restriction circuit (including a pulse by pulse system), a noise filter choke coil of a common mode, or normal mode, a noise filter capacitor etc., may be added to each part of circuit arrangement shown in the embodiments if needed. The structure of the discharge lamp lighting apparatus is not limited to the circuits disclosed in this specification. As to industrial application, the present invention relates to improvements of a discharge lamp lighting apparatus for lighting a high pressure discharge lamp. For example, the present invention may be used in a high intensity discharge lamp, such as an optical apparatus for an image display, such as a projector.

The preceding description has been presented only to illustrate and describe exemplary embodiments of the present discharge lamp lighting apparatus. It is not intended to be exhaustive or to limit the invention to any precise form disclosed. It will be understood by those skilled in the art that various changes may be made and equivalents may be substituted for elements without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp lighting apparatus for lighting a discharge lamp in which a pair of electrodes for main discharge face each other, comprising:

a power supply circuit that supplies electric power to the discharge lamp;

an electric supply control circuit that controls the power supply circuit;

an inverter that is provided in a downstream side of the power supply circuit and that performs polarity reversals of voltage to be impressed to the discharge lamp;

a periodic drive circuit for generating an inverter drive signal, which is a periodic signal for carrying out a periodic drive of the inverter;

a transformer, which has a primary side winding and a secondary side winding; and an intermittent voltage applying unit for performing a voltage impression drive to the primary side winding, wherein the secondary side winding of the transformer is inserted in a path that connects an output of the inverter and the electrodes for main discharge of the discharge lamp to each other, so that a voltage generated in the secondary side winding can be superimposed on an output voltage of the inverter and is impressed between the electrodes of the discharge lamp, wherein in a starting sequence of the discharge lamp, while the periodic drive circuit generates the inverter drive signal so that the frequency of the inverter becomes a start-up initial frequency that is higher than stable lighting frequency, the electric supply control circuit controls the power supply circuit to output no-load opening voltage, which is voltage sufficient to maintain electric discharge of the discharge lamp, wherein the periodic drive circuit generates the inverter drive signal so that the frequency of the inverter gradually decreases until reaching a first threshold frequency from the start-up initial frequency, wherein when the frequency of the inverter reaches the first threshold frequency, the periodic drive circuit generates the inverter drive signal so that the frequency of the inverter becomes the stable lighting frequency, and wherein the electric supply control circuit controls the power supply circuit to output current, which is sufficient to maintain electric discharge of the discharge lamp.

2. The discharge lamp lighting apparatus according to claim 1, wherein when the frequency of the inverter reaches the first threshold frequency, before the periodic drive circuit generates the inverter drive signal so that the frequency of the inverter becomes the stable lighting frequency, the periodic drive circuit generates the inverter drive signal so that the frequency of the inverter becomes the second threshold frequency that is lower than the first threshold frequency, and an operation where the inverter drive signal is generated to gradually decrease the frequency of the inverter until the frequency of the inverter reaches the stable lighting frequency.

3. The discharge lamp lighting apparatus according to claim 2, wherein, along with an operation of the periodic drive circuit, which generates the inverter drive signal to gradually decrease the frequency of the inverter until the frequency of the inverter reaches the first threshold frequency from the start-up initial frequency, the electric supply control circuit controls the power supply circuit to output voltage, which gradually decreases until the voltage reaches predetermined voltage that is lower than the no-load opening voltage.

4. The discharge lamp lighting apparatus according to claim 3, wherein a capacitor is connected to the transformer, in which electric capacity of the capacitor is set up so that free oscillation frequency of voltage generated in the secondary side winding is 3 MHz or less, and wherein in a starting period of the discharge lamp, there is a period in which the intermittent voltage applying unit continues a voltage impression drive even after the voltage impression drive is performed at average frequency of 8,000 times/second or more whereby electric discharge of the discharge lamp is started.

5. The discharge lamp lighting apparatus according to claim 4, wherein a total of inductance components along with a path of main discharge current of the discharge lamp in a downstream side from the inverter is set to 160 μH or less.

6. The discharge lamp lighting apparatus according to claim 1, wherein, along with an operation of the periodic drive circuit, which generates the inverter drive signal to gradually decrease the frequency of the inverter until the frequency of the inverter reaches the first threshold frequency from the start-up initial frequency, the electric supply control circuit controls the power supply circuit to output voltage, which gradually decreases until the voltage reaches predetermined voltage that is lower than the no-load opening voltage.

7. The discharge lamp lighting apparatus according to claim 6, wherein a capacitor is connected to the transformer, in which electric capacity of the capacitor is set up so that free oscillation frequency of voltage generated in the secondary side winding is 3 MHz or less, and wherein in a starting period of the discharge lamp, there is a period in which the intermittent voltage applying unit continues a voltage impression drive even after the voltage impression drive is performed at average frequency of 8,000 times/second or more whereby electric discharge of the discharge lamp is started.

8. The discharge lamp lighting apparatus according to claim 7, wherein a total of inductance components along with a path of main discharge current of the discharge lamp in a downstream side from the inverter is set to 160 μH or less.

9. The discharge lamp lighting apparatus according to claim 1, wherein a capacitor is connected to the transformer, in which electric capacity of the capacitor is set up so that free oscillation frequency of voltage generated in the secondary side winding is 3 MHz or less, and wherein in a starting period of the discharge lamp, there is a period in which the intermittent voltage applying unit continues a voltage impression drive even after the voltage impression drive is performed at average frequency of 8,000 times/second or more whereby electric discharge of the discharge lamp is started.

10. The discharge lamp lighting apparatus according to claim 9, wherein a total of inductance components along with a path of main discharge current of the discharge lamp in a downstream side from the inverter is set to 160 μH or less.

11. The discharge lamp lighting apparatus according to claim 9, wherein the intermittent voltage applying unit comprises a power supply for a voltage impression drive, and a voltage impression drive switching elements, and wherein voltage is impressed to the primary side winding in an ON state of the voltage impression drive switching element.

* * * * *